US007690770B2

(12) United States Patent
Ito

(10) Patent No.: US 7,690,770 B2
(45) Date of Patent: Apr. 6, 2010

(54) SHEET-MEMBER STACKED STRUCTURE, LEAD FRAME, LEAD-FRAME STACKED STRUCTURE, SHEET-MEMBER STACKED AND ADHERED STRUCTURE, AND INK JET PRINTER HEAD

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1614 days.

(21) Appl. No.: 10/888,181

(22) Filed: Jul. 8, 2004

(65) Prior Publication Data

US 2005/0040581 A1 Feb. 24, 2005

(30) Foreign Application Priority Data

Jul. 8, 2003 (JP) ..... 2003-193842
Jul. 23, 2003 (JP) ..... 2003-200254
Jul. 25, 2003 (JP) ..... 2003-201674

(51) Int. Cl.
*B41J 2/045* (2006.01)

(52) U.S. Cl. ..... 347/71; 347/68

(58) Field of Classification Search ..... 347/68, 347/71

See application file for complete search history.

(56) References Cited

U.S. PATENT DOCUMENTS 5,402,159 A 3/1995 Takahashi et al.
6,536,879 B2 3/2003 Ito
6,648,455 B2 11/2003 Takagi
6,666,547 B1 12/2003 Takahashi et al.
7,076,873 B2 7/2006 Sugahara et al.
7,159,315 B2 1/2007 Takahashi et al.
2002/0036678 A1 3/2002 Ito et al.
2002/0042994 A1 4/2002 Ito et al.
2003/0103116 A1 6/2003 Sugahara et al.
2005/0139315 A1 6/2005 Ito et al.
2007/0067991 A1 3/2007 Takahashi et al.
2008/0244906 A1 10/2008 Takahashi et al.

FOREIGN PATENT DOCUMENTS

EP 1024001 A2 8/2000
JP H03-205709 9/1991

(Continued)

*Primary Examiner*—Manish S Shah
*Assistant Examiner*—Geoffrey Mruk
(74) *Attorney, Agent, or Firm*—Eugene Ledonne; Joseph W. Treloar; Frommer Lawrence & Haug

(57) ABSTRACT

A sheet-member stacked structure produced by a method including one or more of the following steps: stacking lead frames on each other, and stacking sheet members of one lead frame on sheet members of another or other lead frame or frames, each lead frame including a frame portion, the sheet members, and bridge portions which connect sides of the sheet members; to an inner peripheral portion of the frame portion and one of its adjacent sheet member, or to respective one sides of its two adjacent sheet members; stacking sheet members on each other via an adhesive; and stacking sheet members on each other, the sheet members including a liquid-chamber sheet member formed of a rolled metal sheet and having liquid chambers arranged, separately from each other, in a direction perpendicular to a direction of rolling of the metal sheet.

16 Claims, 24 Drawing Sheets

FOREIGN PATENT DOCUMENTS

| | | | |
|---|---|---|---|
| JP | A-4-341853 | | 11/1992 |
| JP | 5330067 | | 12/1993 |
| JP | 2000-246363 | | 9/2000 |
| JP | 2000-280474 | | 10/2000 |
| JP | 2001105595 | * | 4/2001 |
| JP | A-2001-105595 | | 4/2001 |
| JP | 2002-36545 | | 2/2002 |
| JP | 2002-59547 | | 2/2002 |
| JP | 2002-096477 | | 4/2002 |
| JP | 2002-96478 | | 4/2002 |
| JP | 2002-105410 | * | 4/2002 |
| JP | A-2002-192732 | | 7/2002 |
| JP | 2002-234170 | | 8/2002 |
| JP | 2003-165216 | | 3/2003 |
| JP | 2000-280474 | | 10/2008 |

* cited by examiner

SHEET-MEMBER STACKED STRUCTURE, LEAD FRAME, LEAD-FRAME STACKED STRUCTURE, SHEET-MEMBER STACKED AND ADHERED STRUCTURE, AND INK JET PRINTER HEAD

The present application is based on Japanese Patent Application No. 2003-193842 filed on Jul. 8, 2003, Patent Application No. 2003-200254 filed on Jul. 23, 2003, and Patent Application No. 2003-201674 filed on Jul. 25, 2003, the contents of which are incorporated herein by reference.

BACKGROUND OF THE INVENTION

1. Field of the Invention

The present invention relates to a sheet-member stacked structure; the present invention also relates to a lead frame which may be is used with one or more other lead frames to assemble a plurality of sheet members into a component of, e.g., an ink jet printer head or an electronic device; the present invention also relates to a sheet-member stacked and adhered structure in which a plurality of sheet members are stacked on, and adhered to, each other and which is employed by, e.g., an ink jet printer head or an electronic device; and the present invention also relates to an ink jet printer head and particularly to such a sheet-member-stacked-type ink jet printer head which has a plurality of ink ejection nozzles arranged in at least one array.

2. Discussion of Related Art

There is known a piezoelectric ink jet printer head including a channel unit constituted by a plurality of sheet members which are stacked on, and fixed to, each other with an adhesive and which have a plurality of ink channels including a plurality of pressure chambers; a piezoelectric actuator which applies a pressure to an ink accommodated by each one of the pressure chambers of the channel unit; and a cable member which transmits control data from an external device to the piezoelectric actuator.

The sheet members constituting the channel unit include a nozzle sheet having a plurality of ink ejection nozzles; a base sheet having the pressure chambers corresponding to the ink ejection nozzles; and a manifold sheet having a manifold chamber as a common ink chamber provided between an ink supply source and each of the pressure chambers.

The channel unit is assembled, i.e., the sheet members are stacked on, and fixed to, each other, in a method disclosed by, e.g., Japanese Patent Application Publication No. 2002-105410, in the following manner:

First, a plurality of lead frames of different sorts are prepared. Each of the lead frames includes a substantially rectangular frame portion; a plurality of sheet members of a same sort that are arranged inside the frame portion such that the sheet members extend substantially parallel to each other; and a plurality of bridge portions each of which has a small width and which integrally connect between the frame portion and the corresponding sheet members. Each of the lead frames is prepared by, e.g., etching, while simultaneously a prescribed ink-channel pattern such as a flow passage or a pressure chamber is formed in each of the sheet members of the each lead frame.

After the lead frames are prepared, an adhesive is applied to respective contact surfaces (i.e., respective planar surfaces) of the sheet members. Subsequently, positioning pins of a jig are inserted into positioning holes formed in the frame portion of each of the lead frames. Thus, the lead frames are stacked on each other in a prescribed order, while each group of sheet members that are arranged in a direction of stacking of the lead frames are positioned relative to each other. Then, a pinching force or a pressing force is applied to the uppermost and lowermost lead frames, so that each group of sheet members arranged in the stacking direction are adhered and fixed to each other and are thereby integrated with each other.

Next, the bridge portions are cut off so as to separate each group of integrated sheet members from the frame portions. Thus, a channel unit as a sheet-member stacked structure is obtained.

In the above-indicated ink jet printer head, each of the sheet members constituting the channel unit may have a substantially rectangular shape that is elongate in a direction in which the ink ejection nozzles are arranged, for the purpose of increasing the total number of the nozzles employed and thereby increasing a printing speed of the printer head.

In each of the conventional lead frames constructed as described above, two opposite short-side end portions (i.e., two opposite short sides) of each of the sheet members are integrally connected to the frame portion via the respective thin bridge portions, but two opposite long-side end portions (i.e., two opposite long sides) of the each sheet member are not connected to the frame portion or any other portion. Therefore, if two opposite long-side portions of the frame portion are grasped by a person's hand, e.g., when an adhesive is applied to the each lead frame or when the lead frames are stacked on each other, each of the sheet members may be so sharply curved or deformed as to have a generally V-shaped cross section as seen in a direction in which the sheet members are arranged inside the frame portion, depending upon the manner of grasping. In addition, when each lead frame is washed or when an adhesive is applied to the each lead frame, an external force may be exerted to each sheet member, so that the each sheet member may be curved or deformed as described above.

If the curved sheet members are stacked on each other, and are fixed to each other with the adhesive, then gaps or spaces may be left around the curved portions of the sheet members. Those gaps or spaces may cause defects such as ink leakage.

Meanwhile, there is also known a piezoelectric ink jet printer head including a channel unit in which a plurality of sheet members each having one or more ink channels are stacked on each other and are adhered to each other with an adhesive; a piezoelectric actuator which applies a pressure to the ink accommodated by each of a plurality of pressure chambers of the channel unit; and a cable member which transmits control information from an external device to the piezoelectric actuator.

Japanese Patent Application Publication No. 2002-96478 or its corresponding U.S. Pat. No. 6,536,879 discloses an example of the above-indicated channel unit. This channel unit includes a nozzle sheet having a plurality of ink ejection nozzles; a base sheet having a plurality of pressure chambers communicating with the ink ejection nozzles, respectively; two manifold sheets which cooperate with each other to define one or more manifold chambers which store the ink supplied from an ink supply source and deliver the ink to each of the pressure chambers; and a spacer sheet. The channel unit is assembled such that in a direction from the bottom to the top of the unit, the base sheet, the spacer sheet, the two manifold sheets, and the nozzle sheet are stacked on, and bonded to, each other in the order of description.

At least one of respective contact surfaces (i.e., respective planar surfaces) of each pair of adjacent sheet members that are located adjacent each other in the direction of stacking of the sheet members, has narrow relief grooves that are provided, separately from the pressure chambers or the manifold chambers, along locations where an adhesive is applied. The relief grooves do not extend through the thickness of each sheet member, and open in only one major surface thereof. In addition, each sheet member has air relief holes that are formed through the thickness thereof and communicate with the relief grooves. Thus, each relief groove communicates with ambient air, via the corresponding air relief hole or holes that opens or open in one of opposite major surfaces of the stacked sheet members that are opposite to each other in the stacking direction, but none of the air relief holes open in the other major surface of the stacked sheet members.

When the channel unit is assembled, first, the adhesive is applied to each of the respective contact surfaces of the sheet members, and then the base sheet, the spacer sheet, and the two manifold sheets are stacked on each other in the order of description in the direction from the bottom to the top.

Subsequently, a pinching force or a pressing force is applied to one of the two manifold sheets as the top sheet member and the base sheet as the bottom sheet member, so that the stacked sheet members are adhered and fixed to each other. During this operation, air, or air bubbles that is or are trapped in gaps left between the respective contact surfaces of each pair of adjacent sheet members, or is or are mixed with the adhesive, are discharged into the ambient air via the relief grooves and the air relief holes.

Then, the nozzle sheet is fixed, with the adhesive, to an outer surface of the stacked and adhered sheet members (i.e., an upper surface of the one manifold sheet as the top sheet member).

However, in the case where the viscosity of the adhesive used is too low or the amounts of the adhesive applied are too much, superfluous amounts of the adhesive may flow out of the air relief holes of the top sheet member, when the sheet members are pressed and bonded to each other. Conventionally, those superfluous amounts of the adhesive are wiped off after the sheet members are integrated with each other and before the nozzle sheet is adhered to the thus obtained integral structure. However, this operation is time-consuming and cumbersome.

In addition, the wiping operation may result in leaving some amounts of adhesive on the outer surface of the integral structure, i.e., the upper surface of the top sheet member. Since the adhesive left hardens around, e.g., the respective open ends of the air relief holes located in the outer or upper surface of the integral structure, and forms bosses, the degree of planarity or flatness of the outer surface of the integral structure is adversely lowered.

Since the superfluous adhesive hardens, and forms unevenness, on the outer surface of the stacked sheet members, i.e., lowers the degree of flatness of the upper surface of the integral structure, the thickness of the adhesive applied to the upper surface so as to adhere the nozzle sheet to that surface cannot be made uniform. This may lead to a defective adhesion of the integral structure and the nozzle sheet. If it is attempted to adhere the nozzle sheet to the outer surface of the integral structure suffering this problem, the nozzle sheet is likely to be warped or inclined, which adversely influences the ink ejecting performance of the ink jet printer head as a final product.

A conventional on-demand ink jet printer head, disclosed by, e.g., Japanese Patent Application Publication No. 2002-36545, and Japanese Patent Application Publication No. 2002-59547 or its corresponding U.S. Pat. No. 6,648,455, employs a channel unit which is constituted by a plurality of sheet members stacked on each other and has a plurality of ink channels. The sheet members include a nozzle sheet having a plurality of ink ejection nozzles; a base sheet having a plurality of pressure chambers communicating with the ink ejection nozzles, respectively; and a manifold sheet having a manifold chamber which is connected to an ink supply source, on one hand, and is additionally connected to each of the pressure chambers, on the other hand. The ink jet printer head additionally employs a piezoelectric actuator including a plurality of piezoelectric ceramic sheets and a plurality of internal electrode layers which are alternately stacked on each other. The internal electrode layers include a plurality of internal common electrodes and a plurality of internal-individual-electrode layers which are alternate with each other in the direction of stacking of the piezoelectric and electrode sheets. Each one of the internal-individual-electrode layers includes a plurality of internal individual electrodes. The internal individual electrodes of the internal-individual-electrode layers cooperate with the common electrodes to sandwich a plurality of portions of each of the piezoelectric sheets and thereby define a plurality of active portions of the piezoelectric actuator. The piezoelectric actuator is stacked on, and bonded to, the channel unit, such that the active portions of the piezoelectric actuator are aligned with the pressure chambers of the channel unit, respectively.

Generally, the above-indicated base sheet having the pressure chambers is constituted by a thin metal sheet, in particular, a rolled metal sheet, e.g., a rolled stainless steel sheet.

In the case where the pressure chambers are formed through the thickness of the base sheet, such that the pressure chambers are arranged in at least one array, a lengthwise direction of each of the pressure chambers is oriented parallel to a widthwise direction of the base sheet and the array of the pressure chambers is oriented parallel to a lengthwise direction of the same. The ink ejection nozzles are arranged at a very short interval of distance in a direction parallel to the lengthwise direction of the base sheet. For example, seventy two ink ejection nozzles are arranged over a length of 1 inch (i.e., 25.4 mm) in a staggered or zigzag fashion. Since the pressure chambers correspond to the ink ejection nozzles, respectively, a thickness of a partition wall located between each pair of adjacent pressure chambers that are located adjacent each other in the array is very small (e.g., from about 0.09 mm to about 0.10 mm). Hence, if the direction in which the pressure chambers are arranged in the array is parallel to the direction of rolling of the metal sheet constituting the base sheet, that is, if a direction perpendicular to the lengthwise direction of each pressure chamber is parallel to the rolling direction, the following problems are encountered:

When a thin metal sheet is produced by rolling, the rolled metal sheet is likely to have, in opposite major surfaces thereof, rolling marks or streaks extending in the rolling direction. Thus, the rolling streaks have irregularity in a direction perpendicular to the rolling direction. In other words, the rolling streaks include microgrooves and microridges each extending in the rolling direction. Therefore, a partition wall located between each pair of adjacent pressure chambers may have, in the opposite surfaces thereof, rolling streaks extending in the direction of arrangement of the pressure chambers. In this case, a thickness of each of respective adhesive layers that are applied to the opposite surfaces of each partition wall when the spacer sheet and the piezoelectric actuator are adhered to the opposite major surfaces of the base sheet, respectively, may not be made uniform because of the presence of microgrooves of the rolling streaks, and the adhesive layers may include such portions that have a very small, or even zero, thickness and provide gaps continuously connecting between the two adjacent pressure chambers along the opposite surfaces of the each partition wall. Therefore, some ink may leak between the two adjacent pressure chambers, and accordingly a droplet of ink may not be ejected from a desired ink ejection nozzle, so that an image may be recorded at an inappropriate position on a recording medium. Thus, the image cannot be recorded with accuracy.

SUMMARY OF THE INVENTION

It is therefore an object of the present invention to provide a sheet-member stacked structure, a lead frame, a lead-frame stacked structure, a sheet-member stacked and adhered structure, and an ink jet printer head each of which is free from at least one of the above-identified problems. It is another object of the present invention to provide such an ink jet printer head which can record an image with accuracy and can be produced at low cost.

The above objects may be achieved according to the following aspects of the present invention.

According to a first aspect of the present invention, there is provided a sheet-member stacked structure produced by a method comprising at least one of the following steps: stacking a plurality of lead frames each of which includes a plurality of sheet members, on each other, and thereby stacking the sheet members of the each lead frame on the sheet members of an other lead frame, or other lead frames, of the plurality of lead frames, the each lead frame including a frame portion and the sheet members each of which has a substantially rectangular shape having two first opposite sides and two second opposite sides, the sheet members being connected to an inner peripheral portion of the frame portion, such that the sheet members are arranged in a first direction, the two first opposite sides of each of the sheet members extend parallel to each other in the first direction, and the two second opposite sides of the each sheet member extend parallel to each other in a second direction substantially perpendicular to the first direction, the lead frame additionally including a plurality of first groups of bridge portions each group of which integrally connect the two first opposite sides of a corresponding one of the sheet members, to the inner peripheral portion of the frame portion, and a plurality of second groups of bridge portions each group of which integrally connect the two second opposite sides of a corresponding one of the sheet members, to the inner peripheral portion of the frame portion and one of the two second opposite sides of an adjacent one of the sheet members that is located adjacent the corresponding sheet member, or to one of the two second opposite sides of one of two adjacent sheet members that are located on either side of, and adjacent, the corresponding sheet member and one of the two second opposite sides of an other of the two adjacent sheet members; stacking a plurality of sheet members on each other via an adhesive, such that respective contact surfaces of each pair of adjacent sheet members of the stacked sheet members are adhered to each other with the adhesive, the contact surface of at least one of the each pair of adjacent sheet members having at least one relief groove which is formed along at least one location where the adhesive is applied and which does not extend through a thickness of the at least one sheet member, each of the stacked sheet members except for one of two opposite, outermost sheet members of the stacked sheet members having at least one relief hole which communicates with the at least one relief groove of the at least one sheet member and which is formed through a thickness of the each sheet member, at least a portion of the at least one relief hole of an other of the two outermost sheet members having a cross-section area greater than a cross-section area of the at least one relief hole of each of the stacked sheet members except for the two outermost sheet members, at least the portion of the at least one relief hole of the other outermost sheet member opening in an outer surface of the other outermost sheet member; and stacking a plurality of sheet members on each other, the sheet members including a liquid-chamber sheet member which is formed of a rolled metal sheet and has a plurality of liquid chambers which are arranged, separately from each other, in a direction substantially perpendicular to a direction of rolling of the metal sheet.

The sheet-member stacked structure produced by the above-described method is free from at least one of the above-indicated conventional problems.

According to a second aspect of the present invention, there is provided a lead frame, comprising a plurality of sheet members each of which has a prescribed pattern formed therein and has a substantially rectangular shape having two first opposite sides and two second opposite sides; a frame portion to an inner peripheral portion of which the sheet members are connected such that the sheet members are arranged in a first direction, the two first opposite sides of the each of the sheet members extend parallel to each other in the first direction, and the two second opposite sides of the each sheet member extend parallel to each other in a second direction substantially perpendicular to the first direction; a plurality of first groups of bridge portions each first group of which integrally connect the two first opposite sides of a corresponding one of the sheet members to the inner peripheral portion of the frame portion; and a plurality of second groups of bridge portions each second group of which integrally connect the two second opposite sides of a corresponding one of the sheet members to the inner peripheral portion of the frame portion and one of the two second opposite sides of an adjacent one of the sheet members that is located adjacent the corresponding sheet member, or to one of the two second opposite sides of one of two adjacent sheet members that are located on either side of, and adjacent, the corresponding sheet member, and one of the two second opposite sides of an other of the two adjacent sheet members.

In the lead frame constructed as described above, even if an external force may be exerted to each of the sheet members, for example, when the each sheet member is washed or when an adhesive material is applied to the each sheet member, or even if two opposite side portions of the frame portion of the lead frame may be grasped when a plurality of lead frames including that lead frame are stacked on each other, the each sheet member can be effectively prevented from being so sharply curved or deformed as to have a generally V-shaped cross section as viewed in the direction of arrangement of the sheet members in the lead frame.

According to a third aspect of the present invention, there is provided a lead-frame stacked structure, comprising a first lead frame including a plurality of first sheet members each of which has a first prescribed pattern formed therein and has a substantially rectangular shape having two first opposite sides and two second opposite sides, a first frame portion to an inner peripheral portion of which the first sheet members are connected such that the first sheet members are arranged in a first direction, the two first opposite sides of the each of the first sheet members extend parallel to each other in the first direction, and the two second opposite sides of the each first sheet member extend parallel to each other in a second direction substantially perpendicular to the first direction, a plurality of first groups of bridge portions each first group of which integrally connect the two first opposite sides of a corresponding one of the first sheet members to the inner peripheral portion of the first frame portion, and a plurality of second groups of bridge portions each second group of which integrally connect the two second opposite sides of a corresponding one of the first sheet members to the inner peripheral portion of the first frame portion and one of the two second opposite sides of an adjacent one of the first sheet members that is located adjacent the corresponding first sheet member, or to one of the two second opposite sides of one of two adjacent first sheet members that are located on either side of, and adjacent, the corresponding first sheet member, and one of the two second opposite sides of an other of the two adjacent first sheet members; and a second lead frame including a plurality of second sheet members each of which has a second prescribed pattern formed therein and has a substantially rectangular shape having two third opposite sides and two fourth opposite sides, a second frame portion to an inner peripheral portion of which the second sheet members are connected such that the second sheet members are arranged in the first direction, the two third opposite sides of the each of the second sheet members extend parallel to each other in the first direction, and the two fourth opposite sides of the each second sheet member extend parallel to each other in the second direction, a plurality of third groups of bridge portions each third group of which integrally connect the two third opposite sides of a corresponding one of the second sheet members to the inner peripheral portion of the second frame portion, and a plurality of fourth groups of bridge portions each fourth group of which integrally connect the two fourth opposite sides of a corresponding one of the second sheet members to the inner peripheral portion of the second frame portion and one of the two fourth opposite sides of an adjacent one of the second sheet members that is located adjacent the corresponding second sheet member, or to one of the two fourth opposite sides of one of two adjacent second sheet members that are located on either side of, and adjacent, the corresponding second sheet member, and one of the two fourth opposite sides of an other of the two adjacent second sheet members. The first lead frame is stacked on the second lead frame, so that the first sheet members are stacked on the second sheet members, respectively.

In the lead-frame stacked structure constructed as described above, when the sheet members of one of the lead frames are adhered, and thereby fixed, to the sheet members of the other lead frame or frames via the adhesive material, no gaps or spaces are left between respective contact surfaces (e.g., respective planar surfaces) of each pair of adjacent sheet members that are located adjacent each other in the direction of stacking of the lead frames. Therefore, the yield of the products obtained by adhering and fixing the respective sheet members of the plurality of lead frames can be improved.

According to a fourth aspect of the present invention, there is provided a sheet-member stacked and adhered structure, comprising a plurality of sheet members which cooperate with each other to define at least one liquid channel and which are stacked on each other via an adhesive such that respective contact surfaces of each pair of adjacent sheet members of the stacked sheet members are adhered to each other with the adhesive. The contact surface of at least one of the each pair of adjacent sheet members of the stacked sheet members has at least one relief groove along at least one location where the adhesive is applied, such that the at least one relief groove does not extend through a thickness of the at least one sheet member and is separate from the at least one liquid channel. Each of the stacked sheet members except for one of two opposite, outermost sheet members of the stacked sheet members has at least one relief hole which communicates with the at least one relief groove of the at least one sheet member and which is formed through a thickness of the each sheet member. The at least one relief hole of an other of the two outermost sheet members includes a first portion having a first cross-section area and opening in the contact surface of the other outermost sheet member, and a second portion having a second cross-section area and opening in an outer surface of the other outermost sheet member. The second cross-section area is greater than the first cross-section area.

In the present sheet-member stacked and adhered structure in which the plurality of sheet members are stacked on, and adhered to, each other, a volume of an inner vacant space of the second (e.g., large-diameter) portion of the relief hole opening outward in the outer surface of the other outermost sheet member is greater than that of the first (e.g., small-diameter) portion of the relief hole. Therefore, a superfluous amount of the adhesive that would otherwise flow to the outer surface of the other outermost sheet member can be accommodated by the second portion of the relief hole, and accordingly the superfluous adhesive can be effectively prevented from leaking to the outer surface of the other outermost sheet member. In addition, a degree of planarity or flatness of the outer surface of the other outermost sheet member can be kept as high as that of each of the sheet members immediately after being worked. Therefore, another member such as a nozzle sheet or a piezoelectric actuator can be appropriately adhered to the other outermost sheet member of the sheet-member stacked and adhered structure.

According to a fifth aspect of the present invention, there is provided a sheet-member stacked and adhered structure, comprising a plurality of sheet members which cooperate with each other to define at least one liquid channel and which are stacked on each other via an adhesive such that respective contact surfaces of each pair of adjacent sheet members of the stacked sheet members are adhered to each other with the adhesive. The contact surface of at least one of the each pair of adjacent sheet members of the stacked sheet members has at least one relief groove along at least one location where the adhesive is applied, such that the at least one relief groove does not extend through a thickness of the at least one sheet member and is separate from the at least one liquid channel. Each of the sheet members except for one of two outermost sheet members of the stacked sheet members has at least one relief hole which communicates with the at least one relief groove of the at least one sheet member and which is formed through a thickness of the each sheet member. The at least one relief hole of an other of the two outermost sheet members has a first cross-section area greater than a second cross-section area of the at least one relief hole of one of the plurality of sheet members that is located adjacent the other outermost sheet member.

In the sheet-member stacked and adhered structure constructed according the fifth aspect of the present invention, the relief hole of the other outermost sheet member functions, as a whole, like the second portion of the relief hole of the other outermost sheet member employed according to the fourth aspect of the present invention, and accordingly enjoys the same advantages as those of the structure according to the fourth aspect of the present invention.

According to a sixth aspect of the present invention, there is provided an ink jet printer head, comprising a channel unit including a plurality of sheet members which are stacked on each other and which have a plurality of ink ejection nozzles opening in an outer surface of the channel unit, a plurality of ink chambers communicating with the ink ejection nozzles, respectively, a plurality of ink channels which connect the ink chambers to the ink ejection nozzles, respectively, and at least one manifold chamber which stores at least one sort of ink supplied from at least one ink supply source and supplies the at least one sort of ink to the ink chambers. The sheet members include an ink-chamber sheet member which has a plurality of recesses defining the ink chambers and which is formed of a rolled metal sheet. The ink chambers are arranged, separately from each other in a direction substantially perpendicular to a direction of rolling of the metal sheet.

In the ink jet printer head constructed according to the sixth aspect of the present invention, a partition wall is located between each pair of adjacent pressure chambers that are located adjacent each other, such that the partition wall extends parallel to the two adjacent pressure chambers. In addition, the rolled metal sheet has rolling marks or streaks extending in a lengthwise direction of each of the partition walls. Therefore, even if a thickness of an adhesive layer provided on at least one of opposite major surfaces of each partition wall may not be made uniform because of the presence of microgrooves and microridges of the rolling streaks, no portions of the adhesive layer have so small, or even zero, thickness, or continuously connect between the two adjacent pressure chambers. In other words, there are produced, on one or each of the opposite surfaces of each partition wall, no gaps that communicate the two adjacent pressure chambers with each other. Therefore, no ink leaks occur between the two adjacent pressure chambers. Since it is just needed to recognize the direction of rolling of the rolled metal sheet and form, in the rolled metal sheet, the pressure chambers arranged in the direction substantially perpendicular to the rolling direction, the cost of production of the ink jet recording head is not increased in achieving the above-indicated advantage.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described a first embodiment of the present invention, by reference to FIGS. 1 through 6, 7A, 7B, 7C, and 8.

Figure 1:
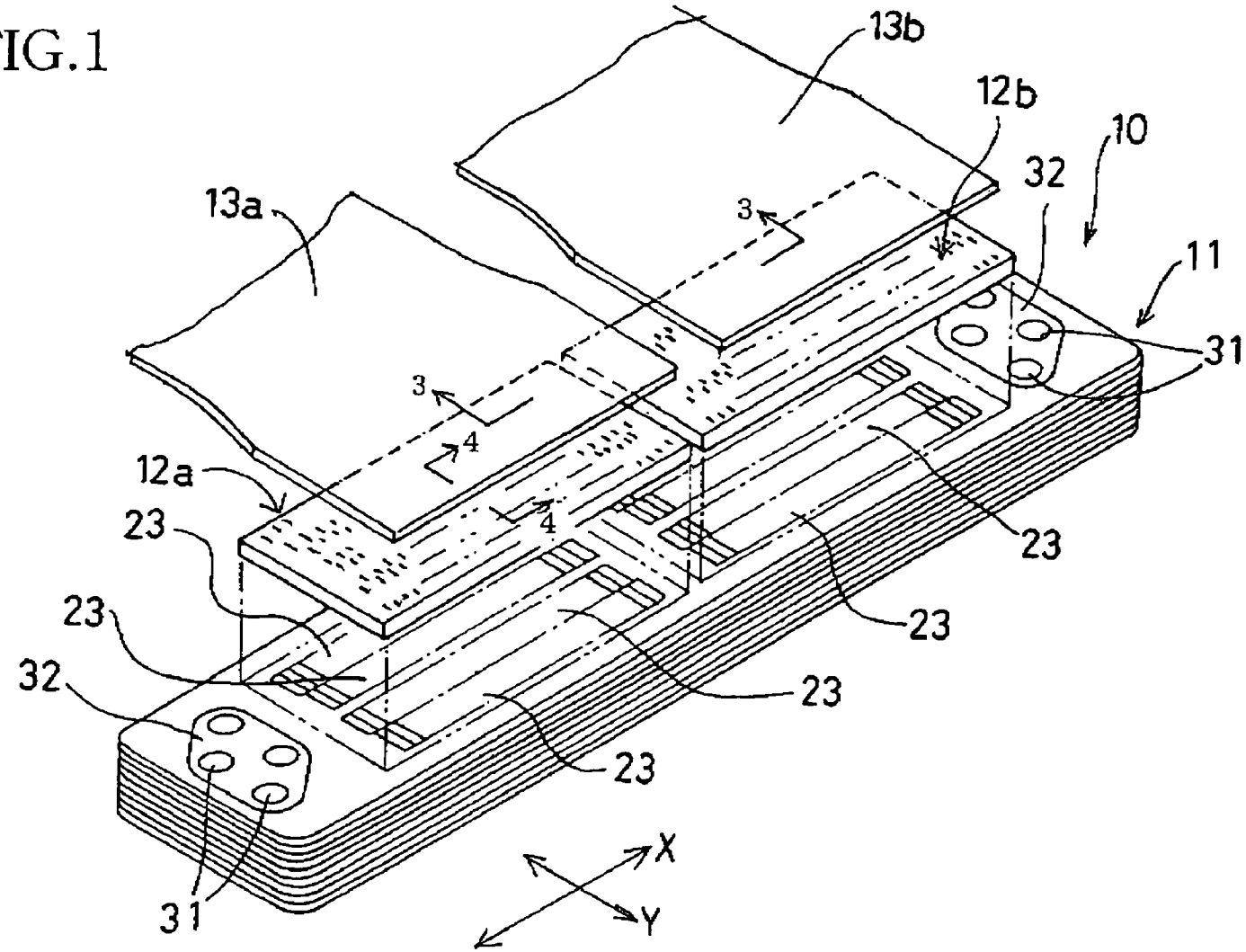
FIG. 1 is a perspective view of a piezoelectric ink jet printer head to which the present invention is applied, a channel unit, two piezoelectric actuators, and two flexible flat cables of the printer head being separated from each other for illustrative purposes only.

First, a piezoelectric-type ink jet printer head 10 to which the present invention is applied is briefly described by reference to FIGS. 1 through 4. In FIG. 1, the piezoelectric ink jet printer head 10 includes, in an order from its bottom to its top, a channel unit 11 constituted by a plurality of stacked metal sheets; two piezoelectric actuators 12*a*, 12*b* each of which is constituted by a plurality of stacked piezoelectric sheets; and two flexible flat cables 13*a*, 13*b* each as a cable member for connecting a corresponding one of the two piezoelectric actuators 12*a*, 12*b* to an external device, not shown. The channel unit 11, the piezoelectric actuators 12*a*, 12*b*, and the flexible flat cables 13*a*, 13*b* are stacked on each other, and are adhered to each other with an adhesive.

Figure 3:
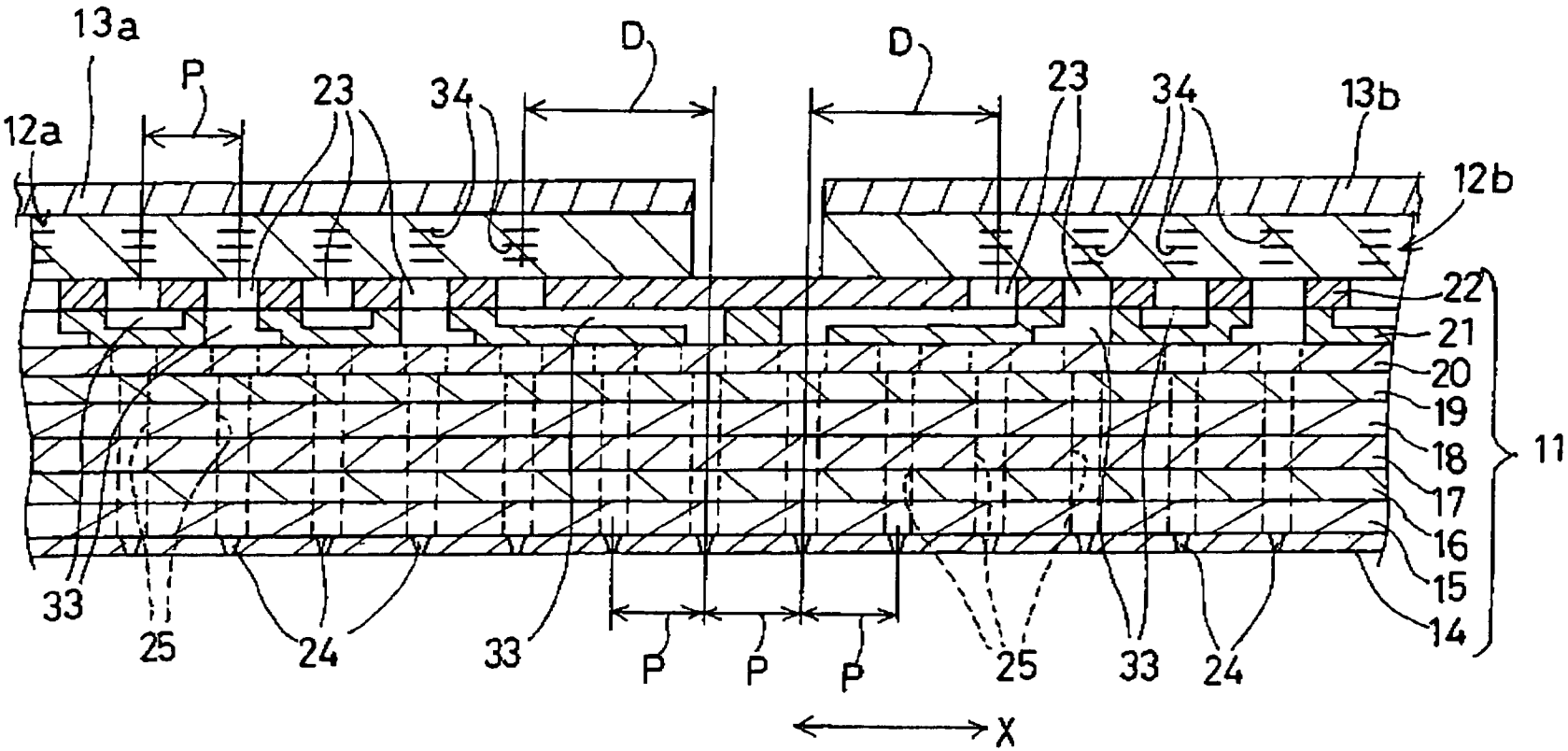
FIG. 3 is an enlarged, cross-sectional view taken along 3-3 in FIG. 1.
Figure 4:
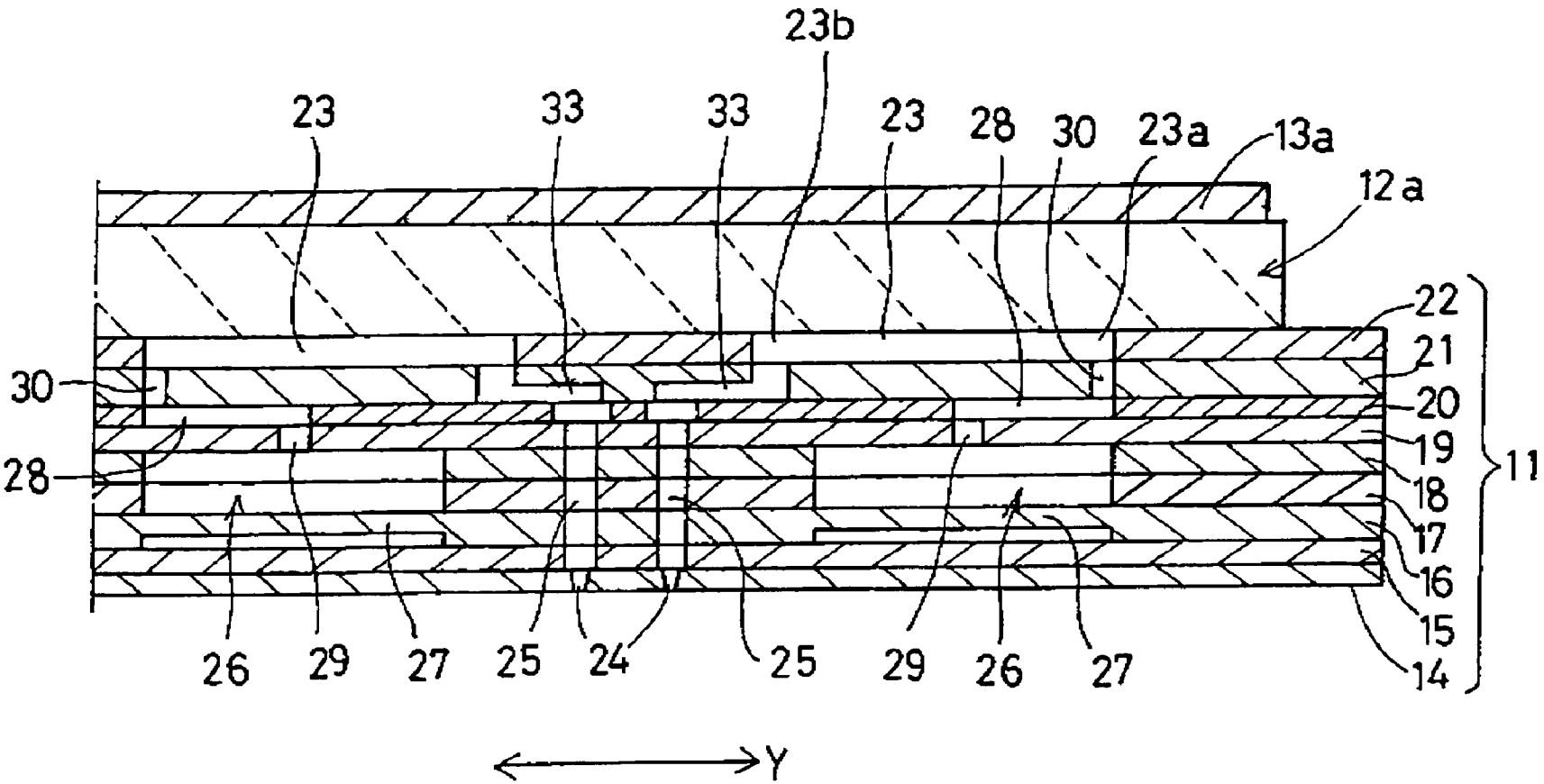
FIG. 4 is an enlarged, cross-sectional view taken along 4-4 in FIG. 1.

As shown in FIGS. 3 and 4, the channel unit 11 is constituted by nine thin sheets that are stacked on, and bonded with an adhesive to, each other. The nine sheets are, in an order from their bottom to their top, a nozzle sheet 14, an intermediate sheet 15, a damper sheet 16, a first and a second manifold sheet 17, 18, a first, a second, and a third spacer sheet 19, 20, 21, and a base sheet 22 having a plurality of pressure chambers 23 each as an ink chamber.

Figure 23:
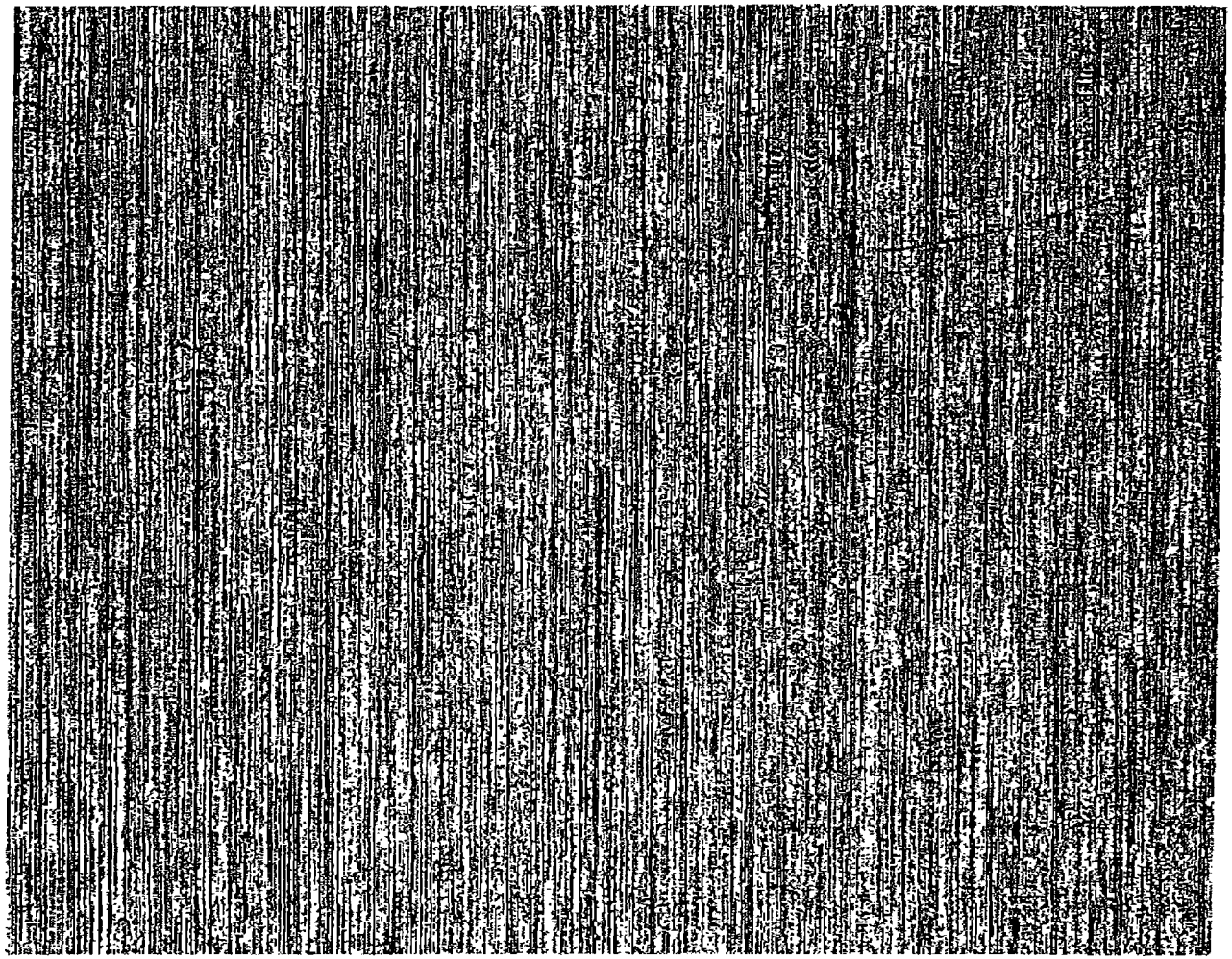
FIG. 23 is a photograph showing microgrooves as rolling marks or streaks that are formed on a surface of a metal sheet when the metal sheet is produced by rolling.

In the present embodiment, each of the sheet members 14 through 22 is formed of a 42% nickel alloy steel sheet, and has a thickness of from about 50 μm to about 150 μm. In particular, the base sheet 22 is formed of a rolled metal sheet, such that the pressure chambers 23 are arranged, separately from each other, in the X-axis direction perpendicular to the Y-axis direction in which a plurality of microgrooves (see FIG. 23) are formed in at least one of opposite major surfaces of the metal sheet when the metal sheet is produced by rolling.

Figure 2:
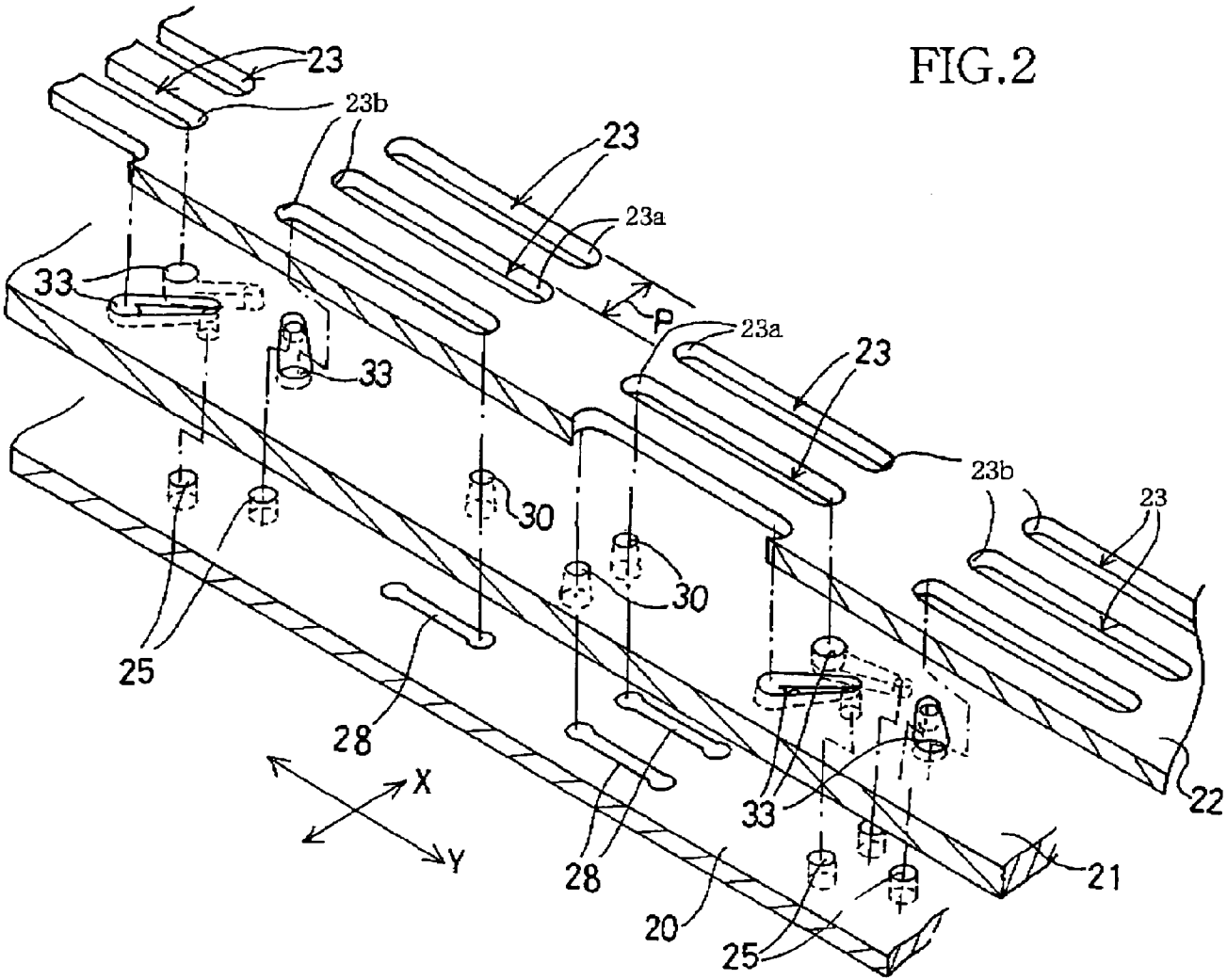
FIG. 2 is an enlarged, partly cut away, perspective view of a base sheet, a third spacer sheet, and a second spacer sheet of the channel unit.

The nozzle sheet 14 has a number of ink ejection nozzles 24 each having a small diameter (e.g., about 25 μm), such that the nozzles 24 are arranged in two pairs of arrays, i.e., four arrays in total, and each pair of arrays of nozzles 24 are arranged in a staggered or zigzag fashion in a first direction of the channel unit 11 or the printer head 10, i.e., a lengthwise direction of the same 11, 10 or an X-axis direction indicated at arrows in FIGS. 1 through 3.

In the present embodiment, each array of nozzles 24 is two-inch long, and the number of nozzles 24 of each array is 150. Thus, the nozzles 24 are arranged at a density of 75 dpi (dots per inch).

As shown in FIGS. 1 and 2, the base sheet 22 as an uppermost sheet of the channel unit 11 (or as one of two opposite, outermost sheets of the unit 11) has four arrays of pressure chambers 23 corresponding to the four arrays of nozzles 24, respectively, such that the arrays of pressure chambers 23 extend in the lengthwise direction of the channel unit 11 or the X-axis direction. The pressure chambers 23 are formed through the thickness of the base sheet 22, at a regular pitch P. Each of the pressure chambers 23 is elongate and extends parallel to a widthwise direction of the channel unit 11 or a Y-axis direction indicated at arrows in FIGS. 1, 2, and 4.

As shown in FIG. 1, the pressure chambers 23 are grouped into two groups corresponding to the two piezoelectric actuators 12*a*, 12*b*, respectively, which are attached to the base sheet 22 such that the two actuators 12*a*, 12*b* are arranged in the lengthwise direction of the channel unit 11 or the X-axis direction.

More specifically described, the first group of pressure chambers 23 corresponding to the first piezoelectric actuator 12*a* are located in one of two half portions of the base sheet 22 as seen in the first direction or the X-axis direction parallel to the arrays of nozzles 24; and the second group of pressure chambers 23 corresponding to the second piezoelectric actuator 12*b* are located in the other half portion of the base sheet 22.

Thus, as shown in FIG. 1, in each of the two groups of pressure chambers 23 corresponding to the two piezoelectric actuators 12*a*, 12*b*, the pressure chambers 23 are arranged in the four arrays, such that the first and second arrays of pressure chambers 23 are arranged in the zigzag fashion and the third and fourth arrays of pressure chambers 23 are also arranged in the zigzag fashion, and such that each array of pressure chambers 23 include 75 pressure chambers 23.

As shown in FIGS. 2 and 4, each of the pressure chambers 23 has an inlet end 23*a* that communicates with a corresponding one of manifold chambers 26, described later, via a second ink passage 30 formed in the third spacer sheet 21, a restrictor passage 28 formed in the second spacer sheet 20, and a first ink passage 29 formed in the first spacer sheet 19. In addition, each of the pressure chambers 23 has an outlet end 23*b* that communicates with a corresponding one of the nozzles 24 via respective communication passages 25 that are formed in the three spacer sheets 21, 20, 19, the two manifold sheets 18, 17, the damper sheet 16, and the intermediate sheet 15 all of which are interposed between the base sheet 22 and the nozzle sheet 14.

One of the communication passages 25 that is formed in the third spacer sheet 21 underlying the base sheet 22 is provided in the form of a bottomed groove 33 that extends substantially parallel to a plane defined by a lower surface of the third spacer sheet 21. Owing to the bottomed grooves 33, the nozzles 24 are offset, by respective appropriate distances D in the first direction or the X-axis direction, from respective positions on the nozzle sheet 14 that are right below the respective outlet ends 23*b* of the corresponding pressure chambers 23.

As shown in FIG. 4, the two manifold sheets 17, 18 cooperate with each other to define a plurality of manifold chambers 26, such that the manifold chambers 26 extend along the arrays of nozzles 24 in the X-axis direction, and such that the manifold chambers 26 overlap, in their plan view, the arrays of pressure chambers 23.

Each of the manifold chambers 26 is formed through the respective thickness of the two manifold sheets 17, 18, and has a length corresponding to a quotient obtained by dividing the length of each array of pressure chambers 23 in the first direction, by the number of the groups of pressure chambers 23, i.e., two.

The manifold chambers 26 are fluid-tightly closed by the damper sheet 16 and the first spacer sheet 19, since the two manifold sheets 17, 18 are sandwiched by those sheet members 16, 19.

In the present embodiment, since the base plate 22 has the two groups of pressure chambers 23 each group of which includes the four arrays of pressure chambers 23, the two manifold sheets 17, 18 have eight manifold chambers 26 in total.

As shown in FIG. 1, one of lengthwise opposite ends of each of the eight manifold chambers 26 communicates with respective ink supply holes 31 that are formed in the three spacer sheets 19-21 and the base sheet 22 that are stacked on the manifold sheets 17, 18. Each of the four ink supply holes 31 that are formed in each of opposite end portions of the uppermost base sheet 22 is covered with a filter 32 that removes dust from a plurality of sorts of inks supplied from a plurality of ink supply sources, not shown, such as ink cartridges or ink tanks.

As shown in FIG. 4, the damper sheet 16 has eight damper walls 27 which are thinned by etching a lower surface of the sheet 16 and each of which has a plan-view shape identical with that of each manifold chamber 26. A pressure wave that is applied by each of the piezoelectric actuators 12*a*, 12*b* to each pressure chamber 23 includes a backward component that propagates backward to the corresponding manifold chamber 26. However, this backward component is effectively absorbed by the vibration of the thinned damper wall 27, and the occurrence of so-called "cross-talk" between two or more pressure chambers 23 adjacent each other in the X-axis direction can be effectively prevented.

In the ink jet printer head 10 constructed as described above, four sorts of inks are supplied from four ink supply sources, not shown, to the eight manifold chambers 26 via the ink supply holes 31 of the base sheet 22 and the three spacer sheets 21 through 19, and each of the four inks is distributed from the corresponding two manifold chambers 26 to the pressure chambers 23 of the corresponding arrays via the corresponding ink passages 29, 30 and restrictor passages 28. Moreover, each sort of ink is delivered from each of the pressure chambers 23 to a corresponding one of the nozzles 24 via the corresponding communication passages 25, 33.

In the present embodiment, each of the pressure chambers 23 of the base sheet 22, the nozzles 24 of the nozzle sheet 14, the communication passages 25, 33 of the other sheets 15 through 21, the manifold chambers 26 of the manifold sheets 17, 18, and the restrictor passages 28 and the ink passages 29, 30 of the spacer sheets 19 through 21 corresponds to an ink flow passage as a prescribed pattern. The respective prescribed patterns of the sheet members 14 through 22 cooperate with each other to provide a plurality of ink channels each as a liquid channel.

Meanwhile, each of the two piezoelectric actuators 12*a*, 12*b* is provided by a plurality of piezoelectric ceramic sheets which are stacked on each other and each of which has a thickness of about 30 μm, though those ceramic sheets are not shown in detail.

As shown in FIG. 3, an individual-electrode layer, i.e., four arrays of individual electrodes 34 (only one array of individual electrodes 34 are shown) each having a small width are provided, on a planar upper surface of each of every second piezoelectric sheets of each piezoelectric actuator 12*a*, 12*b* that are counted upward from its bottom sheet, at respective positions corresponding to the pressure chambers 23 of the channel unit 11, such that the four arrays of individual electrodes 34 extend in a lengthwise direction of the piezoelectric actuator 12*a*, 12*b*, i.e., in the X-axis direction. In addition, a common electrode, not shown, which are common to all the pressure chambers 23 is provided on a planar upper surface of each of the other piezoelectric sheets of each piezoelectric actuator 12*a*, 12*b*. The individual electrodes 34 of each one of the individual-electrode layers are aligned with the individual electrodes 34 of the other individual-electrode layers, in a direction of stacking of the piezoelectric sheets of each piezoelectric actuator 12*a*, 12*b*, and the four arrays of individual electrodes 34 of all the individual-electrode layers cooperate with the common electrodes to sandwich four arrays of active portions of each one of the piezoelectric sheets, in the direction of stacking of the piezoelectric sheets. Those active portions of each piezoelectric sheet are deformed by longitudinal piezoelectric effect.

On an upper surface of the uppermost piezoelectric sheet of each piezoelectric actuator 12*a*, 12*b*, there are provided four arrays of external individual electrodes, not shown, that are electrically connected to the four arrays of individual electrodes 34 of each one of the individual-electrode layers, and an external common electrode, not shown, that is electrically connected to each one of the common electrodes.

An adhesive sheet, not shown, formed of an ink-impermeable synthetic resin as a sort of adhesive material, or a thermosetting adhesive material as another sort of adhesive material is adhered or applied, in advance, to an entire planar lower surface of each sheet-stacked-type piezoelectric actuator 12*a*, 12*b* that is opposed to the pressure chambers 23 of the channel unit 11. Subsequently, in a state in which the individual electrodes 34 of each piezoelectric actuator 12*a*, 12*b* are aligned with the corresponding pressure chambers 23 of the channel unit 11, the each actuator 12*a*, 12*b* is adhered, and thereby fixed, to an upper surface of the channel unit 11.

The two flexible flat cables 13*a*, 13*b* are stacked on, and bonded to, respective upper surfaces of the two piezoelectric actuators 12*a*, 12*b*, such that respective electric wires, not shown, of the flat cables 13*a*, 13*b* are electrically connected to the individual and common external electrodes of the piezoelectric actuators 12*a*, 12*b*, respectively.

In the piezoelectric ink jet printer head 10 constructed as described above, when an electric voltage is applied to arbitrary ones of the individual electrodes 34 that are aligned with each other in the direction of stacking of the piezoelectric sheets and are opposed to a corresponding one of the pressure chambers 23, and the common electrodes, of either one of the piezoelectric actuators 12*a*, 12*b*, the active portion corresponding to the arbitrary individual electrodes 34 is deformed, by the longitudinal piezoelectric effect, in the direction of stacking of the piezoelectric sheets. Since this deformation decreases a volume of the pressure chamber 23 corresponding to the arbitrary individual electrodes 34, a droplet of ink is ejected from the nozzle 24 communicating with the pressure chamber 23, so that a desired image is recorded on a recording medium, not shown, such as a sheet of paper.

In the case where a full-color image is recorded using four sorts of inks, i.e., black, cyan, yellow, and magenta inks, the black ink is ejected from, e.g., the first array of nozzles 24; the cyan ink is ejected from, e.g., the second array of nozzles 24; the yellow ink is ejected from, e.g., the third array of nozzles 24; and the magenta ink is ejected from, e.g., the fourth array of nozzles 24. In this case, the black ink is supplied to the first array of manifold chambers 26 of the manifold sheets 17, 18; the cyan ink is supplied to the second array of manifold chambers 26; the yellow ink is supplied to the third array of manifold chambers 26; and the magenta ink is supplied to the fourth array of manifold chambers 26.

Next, there will be described a method of producing the channel unit 11 as part of the ink jet printer head 10, by reference to FIGS. 5 and 6.

Figure 5:
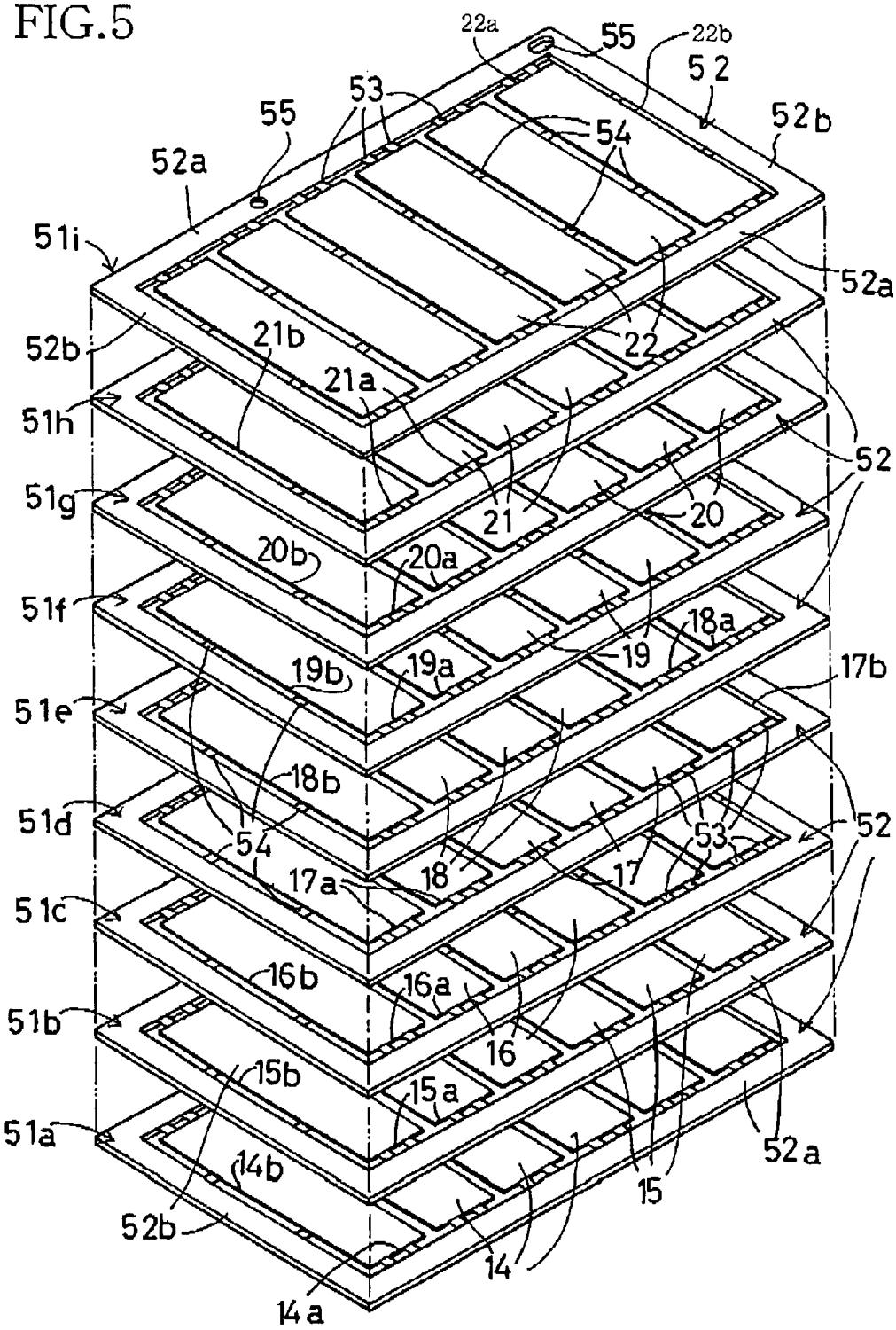
FIG. 5 is a perspective view of a plurality of lead frames that are to be stacked on each other.

As shown in FIG. 5, a lead frame 51*a* includes a plurality of nozzle sheets 14; a lead frame 51*b* includes a plurality of intermediate sheets 15; a lead frame 51*c* includes a plurality of damper sheets 16; a lead frame 51*d* includes a plurality of first manifold sheets 17; a lead frame 51*e* includes a plurality of second manifold sheets 18; a lead frame 51*f* includes a plurality of first spacer sheets 19; a lead frame 51*g* includes a plurality of second spacer sheets 20; a lead frame 51*h* includes a plurality of third spacer sheets 21; and a lead frame 51*i* includes a plurality of base sheets 22. Each of the sheet members 14, 15, 16, 17, 18, 19, 20, 21, 22 has a prescribed pattern formed therein.

More specifically described, each of the lead frames 51*a* through 51*i* includes a frame portion 52 having a substantially rectangular shape, and a group of sheet members 14 through 22 of a same sort each of which has a substantially rectangular shape and which are arranged in a first reference direction inside the frame portion 52 such that respective lengthwise directions of the sheet members are parallel to each other in a second reference direction perpendicular to the first reference direction. Each group of sheet members 14 through 22 of a same sort and the frame portion 52 are integrally connected to each other via a first group of bridge portions 53 and a second group of bridge portions 54. Each of the respective frame portions 52 of the lead frames 51*a* through 51*i* includes two opposite long-side portions 52*a* one of which has two positioning holes 55 into which two positioning pins, not shown, are to be inserted.

In the present embodiment, each of the nine sorts of lead frames 50*a* through 50*i* corresponding to the nine sheet members 14 through 22 of the channel unit 11 is produced by etching or pressing a thin metal sheet formed of stainless steel, or an iron alloy containing 42% Ni (nickel). Simultaneously, respective prescribed patterns in the form of respective ink flow passages such as the pressure chambers 23 or the communication passages 25 are formed, by etching or pressing, in the sheet members 14 through 22 of the lead frames 51*a* through 51*i*. In particular, the lead frame 51*i* including the base sheets 22 is obtained by working a rolled metal sheet such that the direction of rolling of the metal sheet is parallel to the above-indicated first reference direction in which the base sheets 22 are arranged.

Since the lead frames 51*a* through 51*i* have a basically identical construction except that the sheet members 14 through 22 differ from each other, the lead frame 51*i* including the base sheets 22, as a representative of all the lead frames 51*a* through 51*i*, will be described below, by reference to FIG. 6, with respect to a positional relationship between the sheet members (i.e., the base sheets 22) and the first and second groups of bridge portions 53, 54.

The plurality of base sheets 22 each having a substantially rectangular shape are arranged inside the frame portion 52 of the lead frame 51*i*, such that respective lengthwise directions of the base sheets 22 are parallel to each other. Each of two opposite short-side end portions 22*a* (i.e., two first (or third) opposite sides) of each of the base sheets 22 is integrally connected to an inner peripheral portion of a corresponding one of the two long-side portions 52*a* of the frame portion 52 via two first bridge portions 53, 53 which are provided at respective positions such that the two first bridge portions 53, 53 are symmetrical with each other with respect to a first centerline T1 of the each base sheet 22 that perpendicularly intersects the two opposite short-side end portions 22*a* thereof.

Each of the base sheets 22 additionally includes two opposite long-side end portions 22*b* (i.e. two second (or fourth) opposite sides). Since the lead frame 51*i*, shown in FIG. 6, includes six base sheets 22, five pairs of adjacent base sheets 22 each pair of which are located adjacent each other in the first reference direction can be recognized from the six base sheets 22. The respective long-side end portions 22*b*, 22*b* of each pair of adjacent base sheets 22 that are opposed to each other in the first reference direction are integrally connected to each other via two second bridge portions 54, 54. The six base sheets 22 include two "end" base sheets 22 which are respectively located at opposite ends of the six base sheets 22 in the first reference direction. One of the two long-side end portions 22*b* of each of the two "end" base sheets 22 that is opposed to a corresponding one of two opposite short-side portions 52*b* of the frame portion 52 is integrally connected to an inner peripheral portion of the one short-side portion 52*b* via two second bridge portions 54, 54. Each pair of second bridge portions 54, 54 are provided at respective positions such that the two second bridge portions 54, 54 are symmetrical with each other with respect to a second centerline T2 of a corresponding one of the base sheets 22 that perpendicularly intersects the two opposite long-side end portions 22*b* thereof.

Thus, each of the base sheets 22 of the lead frame 51*i* is supported by the two pairs of first bridge portions 53 connected to the two opposite short-side end portions 22*a* of the each base sheet 22 and the two pairs of second bridge portions 54 connected to the two opposite long-side end portions 22*b* of the same 22, i.e., the eight bridge portions 53, 54 in total.

The channel unit 11 is assembled, i.e., the sheet members 14 through 22 are stacked on, and fixed to, each other, as follows: First, a single thin metal sheet (e.g., a rolled metal sheet) is worked, by, e.g., etching, into nine sorts of lead frames 51*a* through 51*i* corresponding to nine sorts of sheet members 14 through 22. Subsequently, an adhesive material is applied to one or more appropriate locations on a planar major surface of each of the sheet members 14 through 22.

Then, two positioning pins, not shown, projecting from a jig are inserted, from underside, into the two positioning holes 55, 55 of each of the respective frame portions 52 of the nine lead frames 51*a* through 51*i*, so that the nine lead frames 51*a* through 51*i* are stacked on each other in a prescribed order while the nine sorts of sheet members 14 through 22 are aligned with each other in a direction of stacking of the lead frames. In the present embodiment, in a direction from the bottom, to the top, of the channel unit 11, the nozzle sheet 14, the intermediate sheet 15, the damper sheet 16, the first and second manifold sheets 17, 18, the first, second, and third spacer sheets 19, 20, 21, and the base sheet 22 are stacked on each other in the order of description.

Next, a pinching force or a pressing force is exerted to the lowermost lead frame 51*a* and the uppermost lead frame 51*i*, so that the nine sorts of sheet members 14 through 22, arranged in the direction of stacking of the lead frames 51*a* through 51*i*, are adhered, and thereby fixed, to each other. Subsequently, a tool, not shown, such as a punch is used to press and punch the first and second bridge portions 53, 54 downward, so that the stacked and adhered sheet members 14 through 22 are separated from the frame portions 52 of the lead frames 51*a* through 51*i*. Thus, the channel units 11 each having the sheet-stacked structure is obtained.

Figure 6:
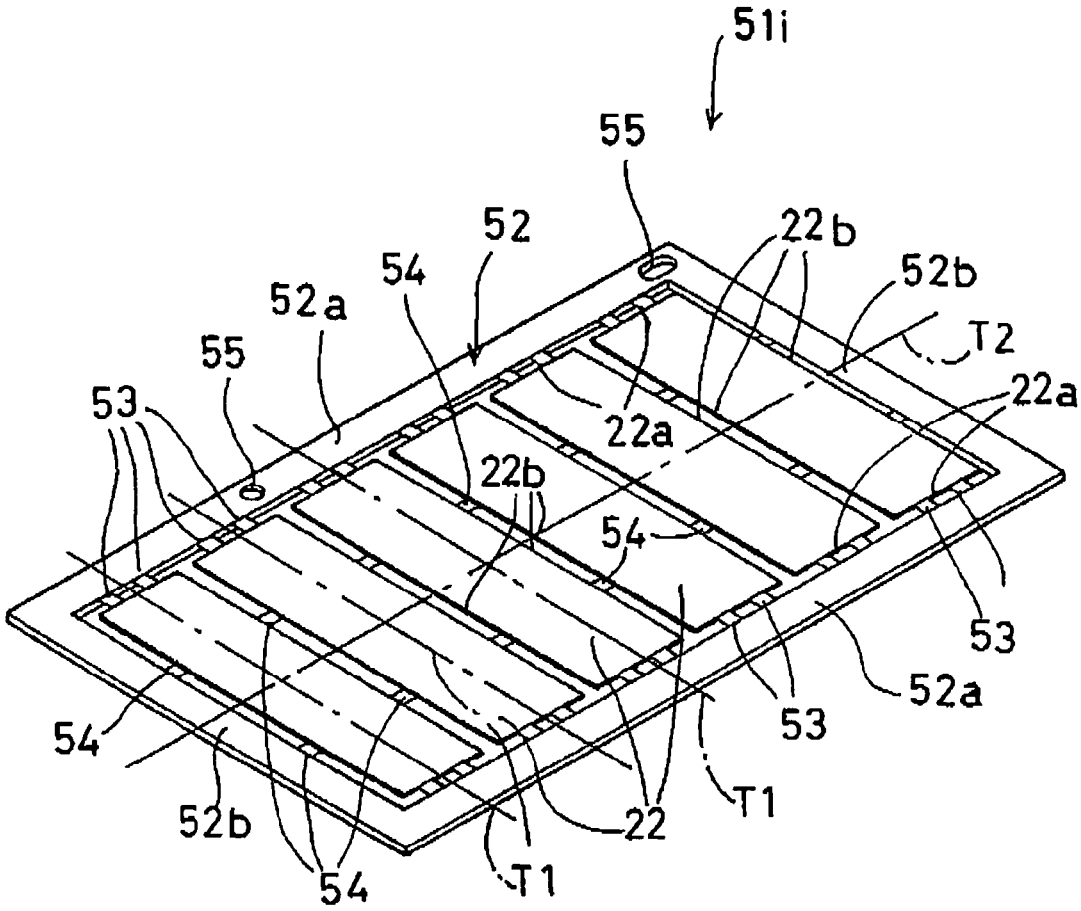
FIG. 6 is a perspective view of a representative one of the lead frames that includes a group of base sheets.

In the present embodiment, six channel units 11 are obtained from the stacked and adhered lead frames 51*a* through 51*i*, as shown in FIGS. 5 and 6. The lead frames 51*a* through 51*i* are may be fixed to each other in a different manner, for example, by welding respective end portions of the stacked sheet members 14 through 22 to each other, or fastening the stacked sheet members 14 through 22 using a clip, not shown.

In each of the lead frames 51*a* through 51*i*, each of the two opposite short-side end portions 14*a* through 22*a* of each of the sheet members 14 through 22 is supported by the two first bridges 53, and each of the two opposite long-side end portions 14*b* through 22*b* of each of the sheet members 14 through 22 is supported by the two second bridges 54. Therefore, for example, even if an external force may be exerted to each of the sheet members 14 through 22, for example, when the each sheet member is washed or when the adhesive material is applied to the each sheet member, or even if the two opposite long-side portions 52*a*, 52 of the frame portion 52 of each of the lead frames 51*a* through 51*i* may be grasped when the lead frames are stacked on each other, each sheet member 14 through 22 can be effectively prevented from being so sharply curved or deformed as to have a generally V-shaped cross section as viewed in the first reference direction, in each lead frame 51*a* through 51*i*.

Thus, when the sheet members 14 through 22 are adhered, and thereby fixed, to each other via the adhesive material, no gaps or spaces are left between the respective contact surfaces (i.e., respective planar surfaces) of each pair of adjacent sheet members of the sheet members 14 through 22 that are located adjacent each other in the direction of stacking of the sheet members. Thus, the ink jet printer head 10 as a final product is freed of various problems such as ink leakage, and accordingly the yield of printer heads 10 can be improved.

The two first bridge portions 53 connected to each of the two opposite short-side end portions of each of the sheet members 14 through 22, and the two second bridge portions 54 connected to each of the two opposite long-side end portions of the same may be replaced with a single first bridge portion 53 and a single second bridge portion 54, respectively. In this case, it is preferred that the single first bridge portion 53 be located on the first centerline T1 and the single second bridge portion 54 be located on the second centerline T2.

Alternatively, the two first bridge portions 53 connected to each short-side end portion 14*a* through 22*a*, and the two second bridge portions 54 connected to each long-side end portion 14*b* through 22*b* may be replaced with an odd number (greater than one) of first bridge portions 53 and an odd number (greater than one) of second bridge portions 54, respectively. In this case, it is preferred that one of the first bridge portions 53 be located on the first centerline T1 and the remaining, even number of first bridge portions 53 be located symmetrically with each other with respect to the first centerline T1, and that one of the second bridge portions 54 be located on the second centerline T2 and the remaining, even number of second bridge portions 54 be located symmetrically with each other with respect to the second centerline T2. Moreover, the two first bridge portions 53 connected to each short-side end portion 14*a* through 22*a*, and the two second bridge portions 54 connected to each long-side end portion 14*b* through 22*b* may be replaced with an even number (greater than two) of first bridge portions 53 and an even number (greater than two) of second bridge portions 54, respectively. In this case, it is preferred that the even number of first bridge portions 53 be located symmetrically with each other with respect to the first centerline T1, and that the even number of second bridge portions 54 be located symmetrically with each other with respect to the second centerline T2.

Thus, each lead frame 51*a* through 51*i* includes, for each of the two opposite short-side end portions of each of the sheet members 14 through 22, at least one of (a) the single first bridge portion 53 located on the first centerline T1 and (b) the even number of first bridge portions 53 located symmetrically with each other with respect to the first centerline T1; and includes, for each of the two opposite long-side end portions of each sheet member 14 through 22, at least one of (a) the single second bridge portion 54 located on the second centerline T2 and (b) the even number of second bridge portions 54 located symmetrically with each other with respect to the second centerline T2. Thus, the first or second bridge portions 53, 54 connected to each sheet member 14 through 22 are well balanced. Therefore, the sheet members 14 through 22 of the lead frames 51*a* through 51*i* can be bonded to each other, while the sheet members are effectively prevented from being plastically deformed and respective degrees of flatness of the sheet members are maintained with reliability.

FIGS. 7A, 7B, 7C, and 8 show respective modified embodiments of the first embodiment shown in FIGS. 1 through 6. Hereinafter, first and second bridge portions 53, 54 that are employed in each of three modified embodiments will be described by reference to FIGS. 7A, 7B, and 7C, respectively.

Figure 7A:
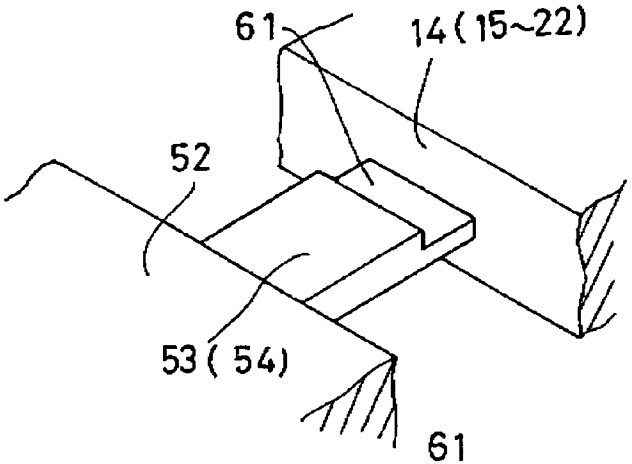
FIG. 7A is a perspective view of a bridge portion of another lead frame as a second embodiment of the present invention.

FIG. 7A shows a first modified embodiment of the first embodiment shown in FIGS. 1 through 6. In this modified embodiment, each of the first and second bridge portions 53, 54 connected to each one of the sheet members 14 through 22 includes, as a portion thereof that is near to a corresponding one of the short-side and long-side end portions of the each sheet member 14 through 22, a weakened portion 61 which is formed, by, e.g., etching, to have a groove and accordingly a thickness smaller than that of the remaining portion of the each bridge portion 53, 54.

In the first modified embodiment shown in FIG. 7A, since shearing forces used to cut off the bridge portions 53, 54 are concentrated to the respective weakened portions 61 of the bridge portions 53, 54 that are low in strength, each of the sheet members 14 through 22 can be easily removed from the corresponding frame portion 52 and one or two adjacent sheet members 14 through 22 that is or are located adjacent the each sheet member. In addition, after the removal of each of the sheet members 14 through 22, no long portions of the bridge portions 53, 54 remain connected to the short-side or long-side end portions of the each sheet member. Moreover, since each of the bridge portions 53, 54 can be cut off with a small shearing force, only a small stress is produced in the each bridge portion 53, 54 when the each bridge portion 53, 54 is cut off. Thus, the sheet members 14 through 22 can be prevented from being deformed, and the adhesive can be prevented from being removed, when the bridge portions 53, 54 are cut off.

Figure 7B:
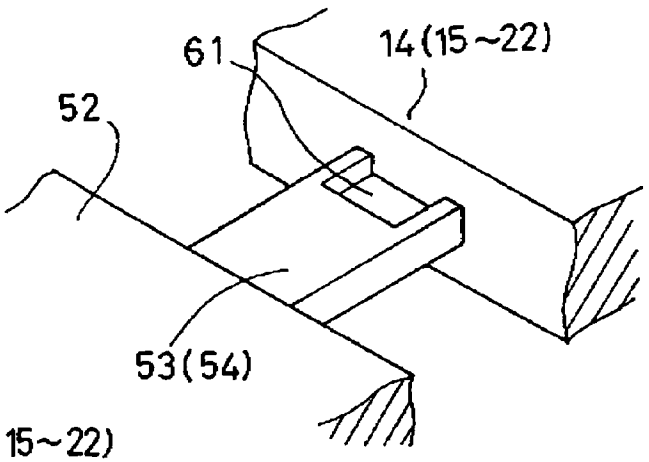
FIG. 7B is a perspective view of a bridge portion of another lead frame as a third embodiment of the present invention.

FIG. 7B shows a second modified embodiment of the present invention in which each of the first and second bridge portions 53, 54 includes a different weakened portion 61 having a recess. For example, in the case where a thickness of each of the bridge portions 53, 54 is considerably small, the each bridge portion 53, 54 including the weakened portion 61 can enjoy a sufficiently high strength while allowing each sheet member 14 through 22 to be easily removed from the corresponding frame portion 52 and one or two adjacent sheet members 14 through 22.

Figure 7C:
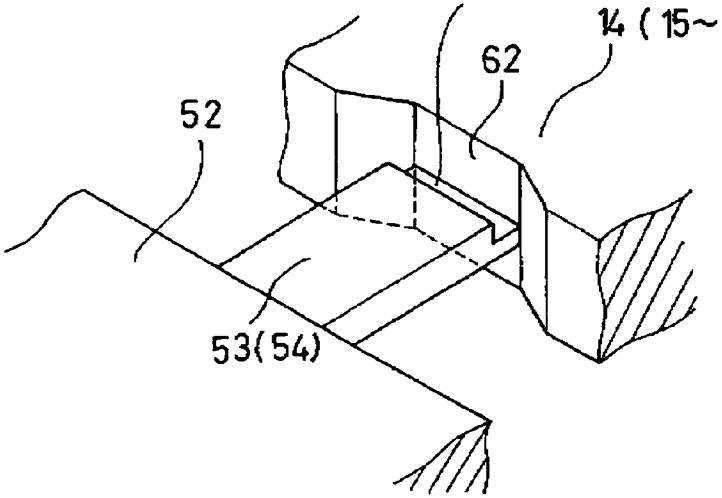
FIG. 7C is a perspective view of a bridge portion of another lead frame as a fourth embodiment of the present invention.

FIG. 7C shows a third modified embodiment of the present invention, in which each of the short-side and long-side end portions of each one of the sheet members 14 through 22 includes, as a portion thereof to which a corresponding one of the first and second bridge portions 53, 54 is connected, a recessed portion 62 which accommodates a weakened portion 61 of the corresponding bridge portion 53, 54 such that no portion of the weakened portion 61 is located outside an inner space of the recessed portion 62, i.e., outside a plane defined by a main side surface of the each short-side or long-wide end portion of the each sheet member.

In the third modified embodiment shown in FIG. 7C, since the weakened portion 61 of each of the first and second bridge portions 53, 54 connected to each one of the sheet members 14 through 22 is located in the recessed portion 62 of a corresponding one of the short-side and long-side end portions of the each sheet member, the each bridge portion 53, 54 can be reliably and easily cut off such that a cut surface of the each bridge portion 53, 54 that remains on the one short-side or long-side end portion is located substantially on, or slightly inward from, the main side surface of the one short-side or long-side end portion of the each sheet member.

In each of the first through third modified embodiments shown in FIGS. 7A, 7B, and 7C, each of the second bridge portions 54 each of which connects between respective long-side end portions of two adjacent sheet members 14 through 22 includes two weakened portions 61, 61 as lengthwise opposite end portions thereof. In this case, when those second bridge portions 54 are cut off, no long portions of the second bridge portions 54 remain connected to the long-side end portions of the sheet members 14 through 22.

The shape of the weakened portion 61 of each of the first and second bridge portions 53, 54 is not limited to the shapes shown in FIGS. 7A and 7B. For example, each weakened portion 61 may have a bridge-like shape, or one or more arrays of perforations, or any one of various combinations of the shapes shown in FIGS. 7A and 7B, the bridge-like shape, and the perforations.

Figure 8:
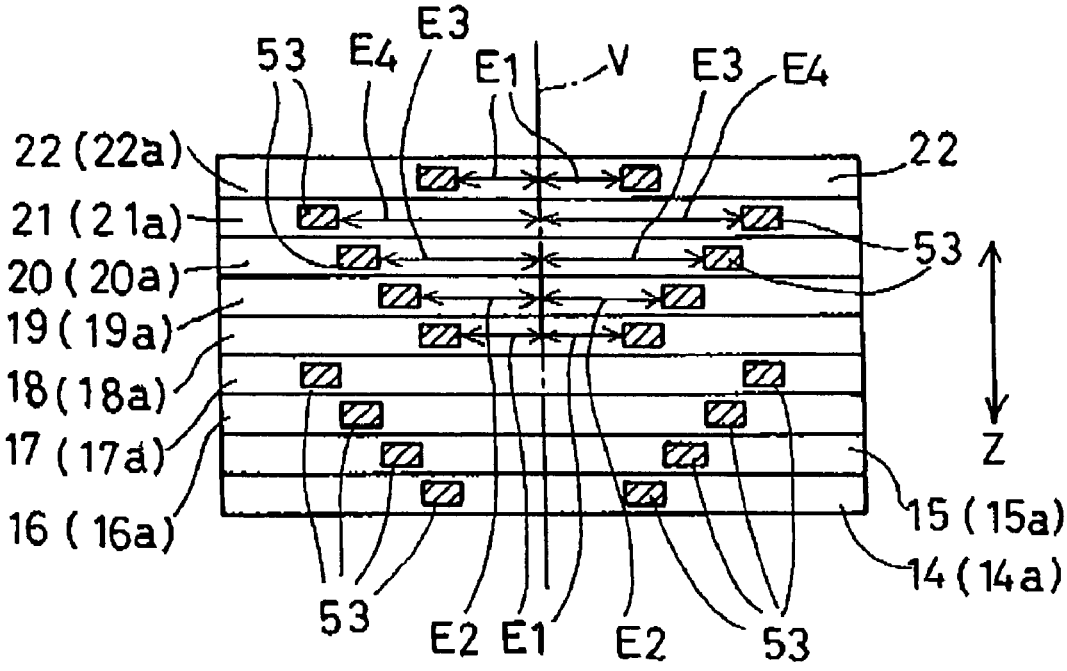
FIG. 8 is a cross-sectional view of respective sheet members of other lead frames as a fifth embodiment of the present invention that are stacked on, and integrated with, each other, as seen from the side of one of opposite short-side end portions of the sheet members.

FIG. 8 shows a fourth modified embodiment in which first and second bridge portions 53, 54 are provided in a different manner. FIG. 8 is a view of integrated sheet members 14 through 22 (i.e., stacked and adhered lead frames 51*a* through 51*i*) as seen from respective short-side end portions 14*a* through 22*a* of the sheet members 14 through 22.

In the fourth modified embodiment, respective first or second bridge portions 53, 54 of each pair of adjacent lead frames 51*a* through 51*i* that are located adjacent each other in a direction of stacking of the lead frames 51*a* through 51*i*, i.e., a Z-axis direction indicated by arrows in FIG. 8 are offset from each other by an appropriate distance such that the first or second bridge portions 53, 54 of each pair of adjacent lead frames do not overlap each other in the Z-axis direction. Although FIG. 8 shows that the first bridge portions 53 of each pair of adjacent lead frames are offset from each other, the second bridge portions 54 of each pair of adjacent lead frames are also offset from each other.

More specifically described, the two first bridge portions 53 connected to each of the two short-side end portions 14*a* through 22*a* of each one of the sheet members 14 through 22 are provided on either side of a first vertical line V which extends in the Z-axis direction and is perpendicular to the first centerline T1 of the each sheet member 14 through 22, shown in FIG. 6, such that the two first bridge portions 53 are distant from the first vertical line V by a corresponding one of different distances E1, E2, E3, E4. Similarly, although not shown, the two second bridge portions 54 connected to each of the two long-side end portions 14*b* through 22*b* of each one of the sheet members 14 through 22 are provided on either side of a second vertical line which extends in the Z-axis direction and is perpendicular to the second centerline T2 of the each sheet member 14 through 22, shown in FIG. 6, such that the two second bridge portions 54 are distant from the second vertical plane by a corresponding one of different distances.

Since the first or second bridge portions 53, 54 of each pair of adjacent lead frames 51*a* through 51*i* do not overlap each other in the Z-axis direction, the first or second bridge portions 53, 54 can be prevented from being adhered to each other with an adhesive material, when the sheet members 14 through 22 are adhered to each other with the adhesive material. Therefore, the first and second bridge portions 53, 54 can be cut off with a small shearing force.

In each of the first embodiment and its modified embodiments, the nine shorts of sheet members 14 through 22 are all given in the form of the respective lead frames 51*a* through 51*i*. However, one or more of the nine sorts of sheet members 14 through 22 may not be given in the form of a lead frame or frames. For example, the eight sorts of sheet members 16 through 22 may be given in the form of the respective lead frames 51*b* through 51*i*, and the nozzle sheets 16 may be formed of a synthetic resin. In this case, after the eight sheet members 16 through 22 given in the form of respective parts of the lead frames 51*b* through 51*i* are stacked on each other as described above, the synthetic-resin-based nozzle sheet 14 is adhered to the stacked sheet members 16 through 22.

The present invention is not limited to the illustrated embodiments, but can be widely embodied in various manners. For example, although, in each of the illustrated embodiments, the present invention is applied to the manufacturing of the ink jet printer head, the present invention can be applied to the manufacturing of an electronic component or device.

In the first and modified embodiments shown in FIGS. 1 through 8, each group of first bridge portions 53 are provided on at least one of (a) the first centerline T1 of the corresponding sheet member 14 through 22 that intersects the two opposite short sides 14*a* through 22*a* thereof and (b) at least one pair of first symmetrical positions which are symmetrical with each other with respect to the first centerline T1; and each group of second bridge portions 54 are provided on at least one of (a) the second centerline T2 of the corresponding sheet member 14 through 22 that intersects the two opposite long sides 14*a* through 22*b* thereof and (b) at least one pair of second symmetrical positions which are symmetrical with each other with respect to the second centerline T2. Thus, the first or second group of bridge portions 53, 54 connected to each sheet member 14 through 22 are well balanced. Therefore, the sheet members 14 through 22 of the lead frame 51*a* through 51*i* are effectively prevented from being plastically deformed, and the degree of flatness of each of the sheet members 14 through 22 is maintained with reliability before the each sheet member is adhered to one or more other sheet members.

In addition, in the modified embodiments shown in FIGS. 7A, 7B, and 7C, each of the bridge portions 53 of each first group includes the weakened portion 61 located at the position nearer to the corresponding sheet member 14 through 22 than the inner peripheral portion of the frame portion 52; and each of the bridge portions 54 of each second group includes the weakened portion 61 located at the position nearer to the corresponding sheet member 14 through 22 than each of the inner peripheral portion of the frame portion 52 and the one long side 14*b* through 22*b* of its adjacent sheet member 14 through 22, or each of the respective one long sides 14*b* through 22*b* of its two adjacent sheet members 14 through 22. According to this feature, shearing forces used to cut off the first or second bridge portions 53, 54 are concentrated to the respective weakened portions 61 of the bridge portions 53, 54 that are low in strength. Therefore, each of the sheet members 14 through 22 can be easily cut off from the frame portion 52 and/or one or two adjacent sheet members 14 through 22 that is or are located adjacent the each sheet member 14 through 22.

In the modified embodiment shown in FIG. 7C, the two opposite short sides 14*a* through 22*a* of each sheet member 14 through 22 include the respective recessed portions 62 to which the bridge portions 53 of a corresponding one of the first groups are connected, such that the respective weakened portions 61 of the bridge portions 53 are located in the respective inner spaces of the respective recessed portions 62; and the two opposite long sides 14*b* through 22*b* of each sheet member 14 through 22 include the respective recessed portions 62 to which the bridge portions 54 of a corresponding one of the second groups are connected, such that the respective weakened portions 61 of the bridge portions 54 are located in the respective inner spaces of the respective recessed portions 62. According to this feature, since the weakened portion 61 of each of the first or second bridge portions 53, 54 connected to each one of the sheet members 14 through 22 is located in the recessed portion 62 of a corresponding one of the short or long side portions 14*a* through 22*a*, 14*b* through 22*b* of the each sheet member 14 through 22, the each bridge portion 53, 54 can be reliably and easily cut off such that a cut surface of the each bridge portion 53, 54 that remains on the one short or long side portion is located substantially on, or slightly inward from, the side surface of the one short or long side portion.

In the modified embodiment shown in FIG. 8, the bridge portions 53 of each first group connected to the corresponding first sheet member, e.g., the corresponding base sheet 22, and the bridge portions 53 of each third group connected to the corresponding second sheet member, e.g., the corresponding spacer sheet 21 that is located adjacent to the corresponding base sheet 22 and is aligned with the same 22 in the direction of stacking of the two lead frames 51*i*, 51*h* are offset from each other so that the bridge portions 53 of the each first group and the bridge portions 53 of the each third group do not overlap each other in the direction of stacking; and the bridge portions 54 of each second group connected to the corresponding first sheet member, e.g., the corresponding base sheet 22, and the bridge portions 54 of each fourth group connected to the corresponding second sheet member, e.g., the corresponding spacer sheet 21 that is located adjacent to the corresponding base sheet 22 and is aligned with the same 22 in the direction of stacking of the first and second lead frames 51*i*, 51*h* are offset from each other so that the bridge portions 54 of each second group and the bridge portions of each fourth group do not overlap each other in the direction of stacking. Since the first or second bridge portions 53, 54 of each pair of adjacent lead frames 51*i*, 51*h*, etc. do not overlap each other in the direction of stacking of the lead frames, the first or second bridge portions 53, 54 can be prevented from being adhered to each other with an adhesive material, when the respective sheet members 14 through 22 of the plurality of lead frames 51*a* through 51*i* are adhered to each other with the adhesive material. Therefore, the first or second bridge portions 53, 54 can be cut off with a small shearing force.

Hereinafter, there will be described a second embodiment of the present invention, by reference to FIGS. 9 through 15, 16A, 16B, 17A, and 17B. First, a piezoelectric-type ink jet printer head 110 to which the present invention is applied will be described briefly by reference to FIGS. 9 through 12.

Figure 9:
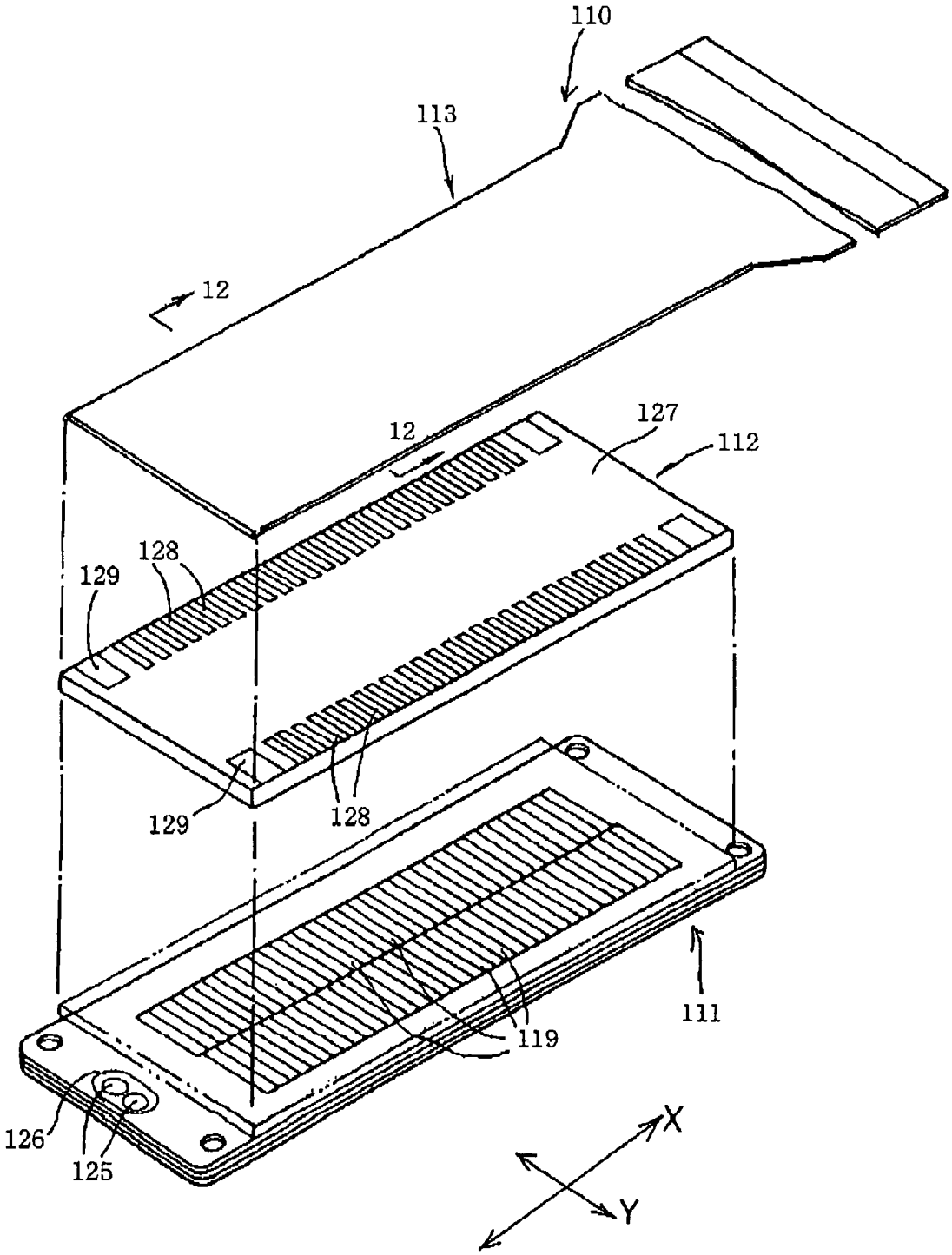
FIG. 9 is a perspective view of another piezoelectric ink jet printer head to which the present invention is applied, a channel unit, a piezoelectric actuator, and a flexible flat cable of the printer head being separated from each other for illustrative purposes only.

As shown in FIG. 9, the piezoelectric ink jet printer head 110 includes, as seen in a direction from its bottom toward its top, a channel unit 111 constituted by a plurality of thin metal sheets; a sheet-stacked-type piezoelectric actuator 112; and a flexible flat cable 113 as an electric cable member for electrically connecting the piezoelectric actuator 112 to an external device, not shown. The channel unit 111, the piezoelectric actuator 112, and the flat cable 113 are stacked on each other, and are bonded to each other with an adhesive. The ink jet printer head 110 ejects a droplet of ink in a downward direction from each of a plurality of ink ejection nozzles 120 (FIG. 2) opening in a lower surface of the channel unit 111 as the lowermost layer of the printer head 110.

Figure 10:
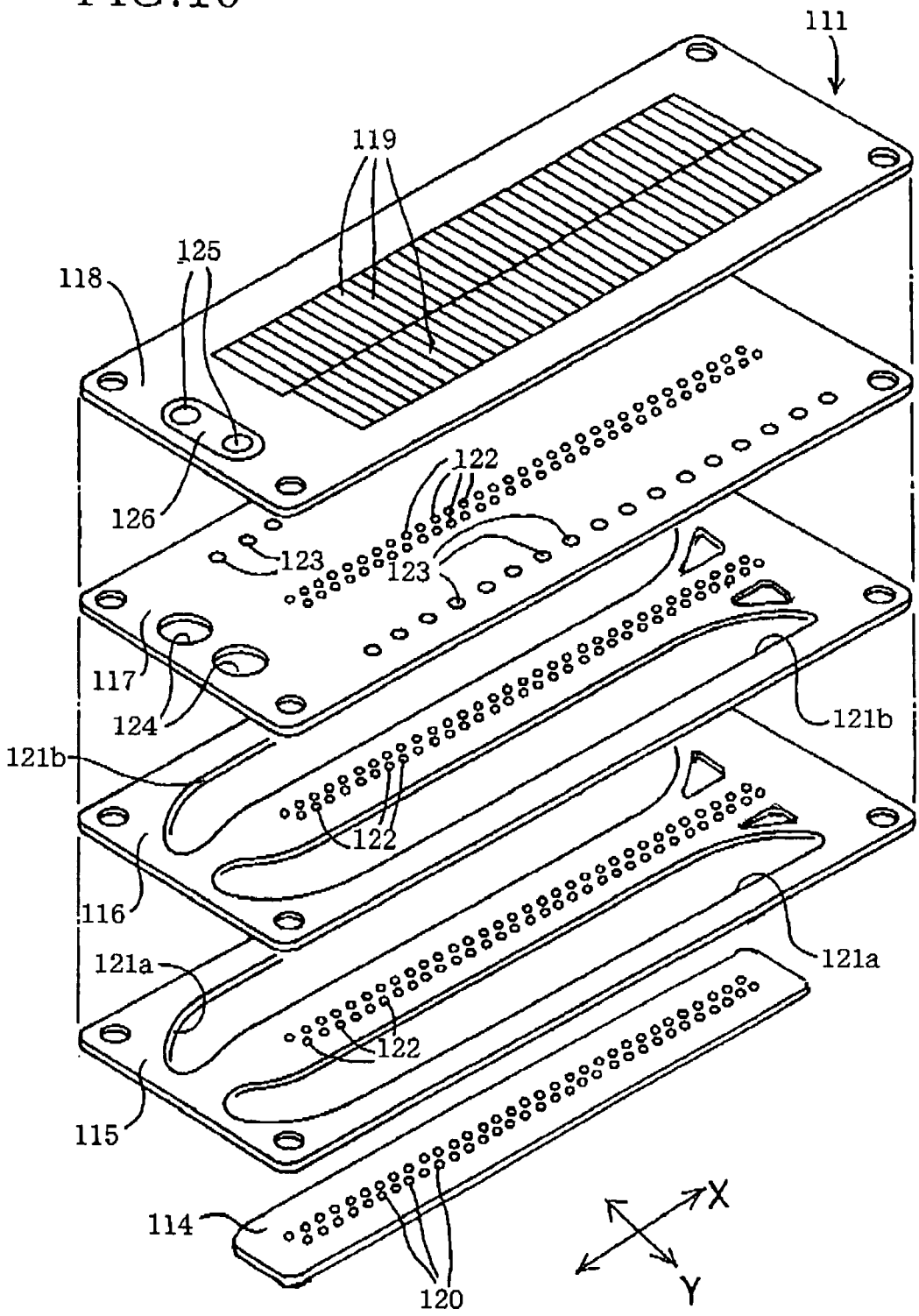
FIG. 10 is an exploded, perspective view of the channel unit shown in FIG. 9.
Figure 11:
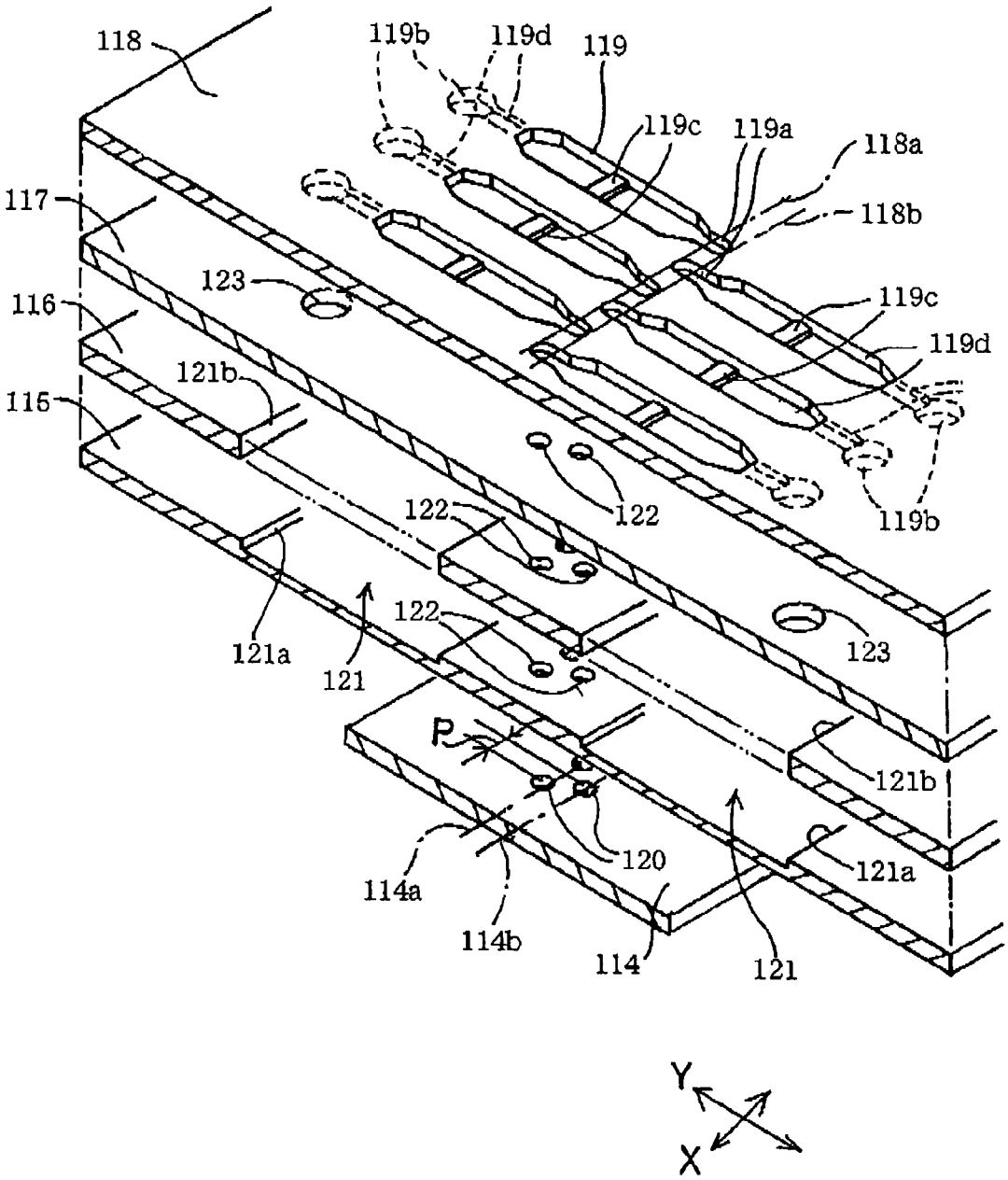
FIG. 11 is an exploded, enlarged, partly cut away, perspective view of the channel unit shown in FIG. 9.
Figure 12:
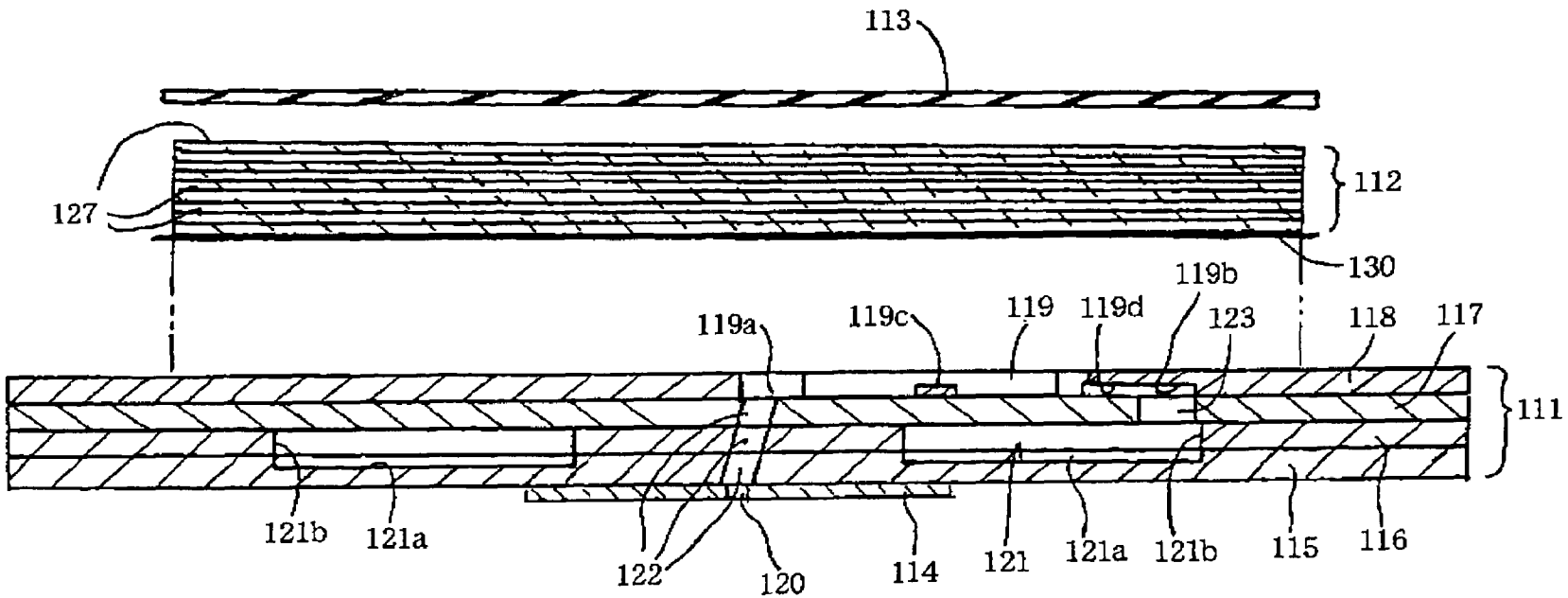
FIG. 12 is an enlarged, cross-sectional view taken along 12-12 in FIG. 9.

As shown in FIGS. 10 through 12, the channel unit 111 has a sheet-stacked structure in which five thin sheets are stacked on each other, and are bonded to each other with an adhesive. More specifically described, the channel unit 111 include, as seen in a direction from its bottom toward its top, a nozzle sheet 114, two manifold sheets 115, 116, a spacer sheet 117, and a base sheet 118 having a plurality of pressure chambers 119.

In the present embodiment, the four sheet members 115, 116, 117, 118, except for the nozzle sheet 114, are each formed of a 42% nickel alloy steel sheet, and have respective thickness values each falling in the range of from about 50 μm to about 150 μm. The nozzle sheet 114 is formed of a synthetic resin. In particular, the base sheet 118 having the pressure chambers 119 is formed of a rolled metal sheet such that the pressure chambers 119 are arranged, separately from each other, in a direction of rolling of the metal sheet.

The nozzle sheet 114 has two arrays of ink ejection nozzles 120, 120 that are arranged along two reference lines 114*a*, 114*b* (FIG. 11), respectively, in a staggered or zigzag fashion, at a regular small interval P of distance, in a first direction (i.e., a lengthwise direction or an X-axis direction) of the channel unit 111 or the printer head 110. Each of the ink ejection nozzles 120 is formed through the thickness of the nozzle sheet 114, and has a small diameter (e.g., about 25 μm).

As shown in FIGS. 10 and 11, the second manifold sheet 116 underlying the spacer sheet 117 has two common ink passages 121*b*, 121*b* that are formed through the thickness thereof, such that the two common ink passages 121*b*, 121*b* extend along, and outside, the two arrays of ink ejection nozzles 120, respectively, i.e., in the first direction of the channel unit 111. As shown in FIGS. 11 and 12, the first manifold sheet 115 overlying the nozzle sheet 114 has two common ink passages 121*a*, 121*a* that are open in only an upper surface thereof, are aligned with the two common ink passages 121*b*, 121*b*, respectively, and have substantially the same shape as that of the common ink passages 121*b*, 121*b*. Each of the two common ink passages 121*b*, 121*b* cooperates with a corresponding one of the two common ink passages 121*a*, 121*a* to define a corresponding one of two common manifold chambers 121, 121. The two common manifold chambers 121, 121 are fluid-tightly closed by the spacer sheet 117 stacked on, and bonded to, the second manifold sheet 116.

As shown in FIGS. 9 through 11, the base sheet 118 has a plurality of pressure chambers 119 that are formed through a thickness thereof such that each of the pressure chambers 119 is elongate in a second direction (i.e., a widthwise direction or a Y-axis direction) of the channel unit 111 or the printer head 110 that is perpendicular to the first direction (i.e., the lengthwise direction or the X-axis direction) of the unit 111 or the head 110.

As shown in FIG. 11, the pressure chambers 119 are arranged in two arrays in a zigzag fashion in the first direction. FIG. 11 shows two reference lines 118*a*, 118*b* extending substantially parallel to the first direction, on either side of a longitudinal centerline, not shown, of the channel unit 111 that extends substantially perpendicularly to two opposite short sides of the unit 111. Respective inner end portions of the pressure chambers 119 of the left-hand array as seen in FIG. 11 include respective inner flow passages 119*a* that reach the right-hand reference line 118*b*; and respective inner end portions of the pressure chambers 119 of the right-hand array include respective inner flow passages 119*a* that reach the left-hand reference line 118*a*.

Thus, the pressure chambers 119 of the left-hand array and the pressure chambers 119 of the right-hand array are alternately arranged in the first direction, and extend in opposite directions, respectively, with respect to the second direction.

As shown in FIGS. 10 and 12, the respective inner flow passages 119*a* of the pressure chambers 119 communicate with the respective ink ejection nozzles 120 of the nozzle sheet 114, via respective communication passages 122 which are formed in a zigzag fashion through a thickness of each of the spacer sheet 117 and the two manifold sheets 116, 115.

Respective outer end portions of the pressure chambers 119 include respective outer flow passages 119*b* each having a large diameter, and respective restrictor portions 119*d* each having a small cross section. The outer flow passages 119*b* communicate with the common manifold chambers 121 of the manifold sheets 116, 115 via two arrays of through-holes 123 that are formed through the thickness of the spacer sheet 117 on either side of the longitudinal centerline of the channel unit 111.

As shown in FIGS. 11 and 12, the respective outer flow passages 119*b* and respective restrictor portions 119*d* of the pressure chambers 119 open in only a lower surface of the base sheet 118. The diameter of each of the outer flow passages 119*b* is substantially equal to that of each of the through-holes 123 of the spacer sheet 117. In addition, the base sheet 118 has, in a lengthwise intermediate portion of each of the pressure chambers 119, a connection portion 119*c* which has a thickness substantially equal to half the thickness of the base sheet 118 and which connects between opposite side walls located on either side of the each pressure chamber 119, for preventing lowering of rigidity of the base sheet 118 having the great number of pressure chambers 119.

As shown in FIGS. 9 and 10, the base sheet 118 as the uppermost layer of the channel unit 111 (i.e., one of two opposite, outermost sheet members of the same 111) has, in one of lengthwise opposite end portions thereof, two ink supply holes 125, 125 that are formed through the thickness of the base sheet 118 and communicate with the two common manifold chambers 121, 121 of the manifold sheets 115, 116, respectively, via two ink supply holes 124, 124, respectively, that are formed through a thickness of a corresponding one of lengthwise opposite end portions of the spacer sheet 117. The ink supply holes 125 of the base sheet 118 are equipped with a filter 126 that removes dust from an ink supplied from an ink supply source, not shown, such as an ink cartridge or an ink tank.

In the channel unit 111 constructed as described above, the ink supplied from the ink supply source to the common manifold chambers 121 via the ink supply holes 125, 124 of the base sheet 118 and the spacer sheet 117, is delivered to the respective pressure chambers 119 via the respective through-holes 123, the respective outer flow passages 119*b*, and the respective restrictor portions 119*d*, and then reach, via the respective inner flow passages 119*a* and the respective through-holes 122, the ink ejection nozzles 120 communicating with the pressure chambers 119, respectively.

In the present embodiment, each of the common ink passages 121*a*, 121*b* (i.e., the common manifold chambers 121), the communication passages 122, the through-holes 123, the pressure chambers 119, the inner flow passages 119*a*, the outer flow passages 119*b*, the restrictor portions 119*d*, the ink supply holes 124, 125, and the ink ejection nozzles 120 corresponds to a prescribed pattern; and the respective prescribed patterns of the sheet members 114 through 118 cooperate with each other to define a plurality of ink channels each as a sort of liquid channel.

Next, there will be described a method of producing the channel unit 111 of the ink jet printer head 110, by reference to FIGS. 13 through 15, 16A, and 16B.

Figure 13:
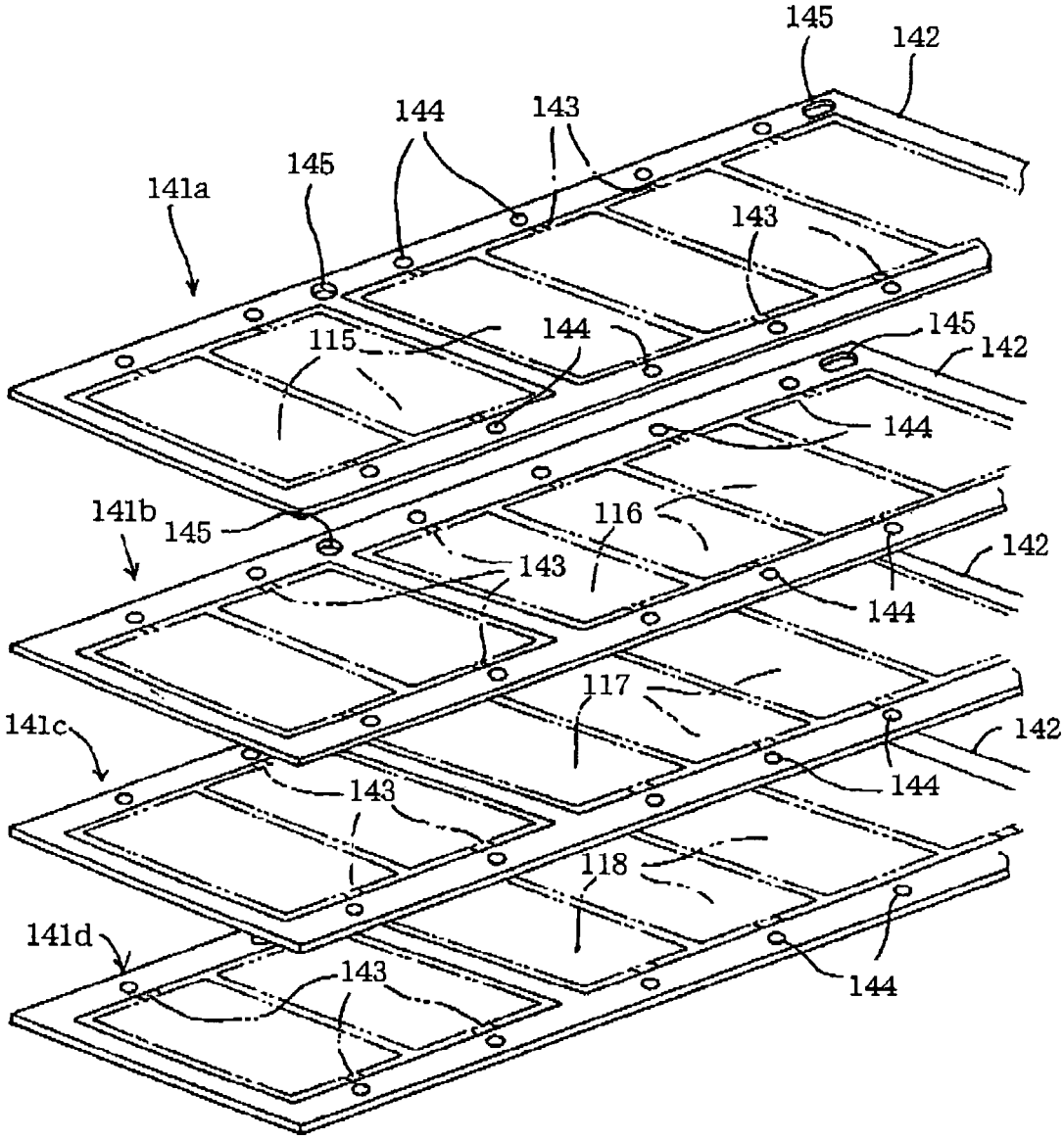
FIG. 13 is an exploded, perspective view of a plurality of lead frames that are to be stacked on each other.

As shown in FIG. 13, a lead frame 141*a* includes a plurality of (e.g., six) first manifold sheets 115; a lead frame 141*b* includes a plurality of second manifold sheets 116; a lead frame 141*c* includes a plurality of spacer sheets 117; and a lead frame 141*d* includes a plurality of base sheets 118. Each of the sheet members 115, 116, 117, 118 has a prescribed ink-channel pattern formed therein.

More specifically described, each of the lead frames 141*a* through 141*d* includes a frame portion 142 having a substantially rectangular shape, and a group of sheet members 115 through 118 of a same sort that are arranged inside the frame portion 142 such that the sheet members extend parallel to each other. Each group of sheet members 115 through 118 of a same sort and the frame portion 142 are integrally connected to each other via bridge portions 143 each having a small width.

In the present embodiment, each of the four sorts of lead frames 141*a* through 141*d* corresponding to the four sorts of sheet members 115 through 118 of the channel unit 111 is produced by etching or pressing a thin metal sheet formed of stainless steel, or an iron alloy containing 42% Ni (nickel). In particular, the lead frame 141*d* including the base sheets 118 is obtained by working a rolled metal sheet such that the direction of rolling of the metal sheet is parallel to a direction in which the base sheets 118 are arranged inside the frame portion 142.

Simultaneously, respective prescribed ink-channel patterns such as the communication passages 122 or the common ink passages 121*a*, 12*ab* are formed, by etching or pressing, in the sheet members 115 through 118 of the lead frames 141*a* through 141*d*.

Figure 14:
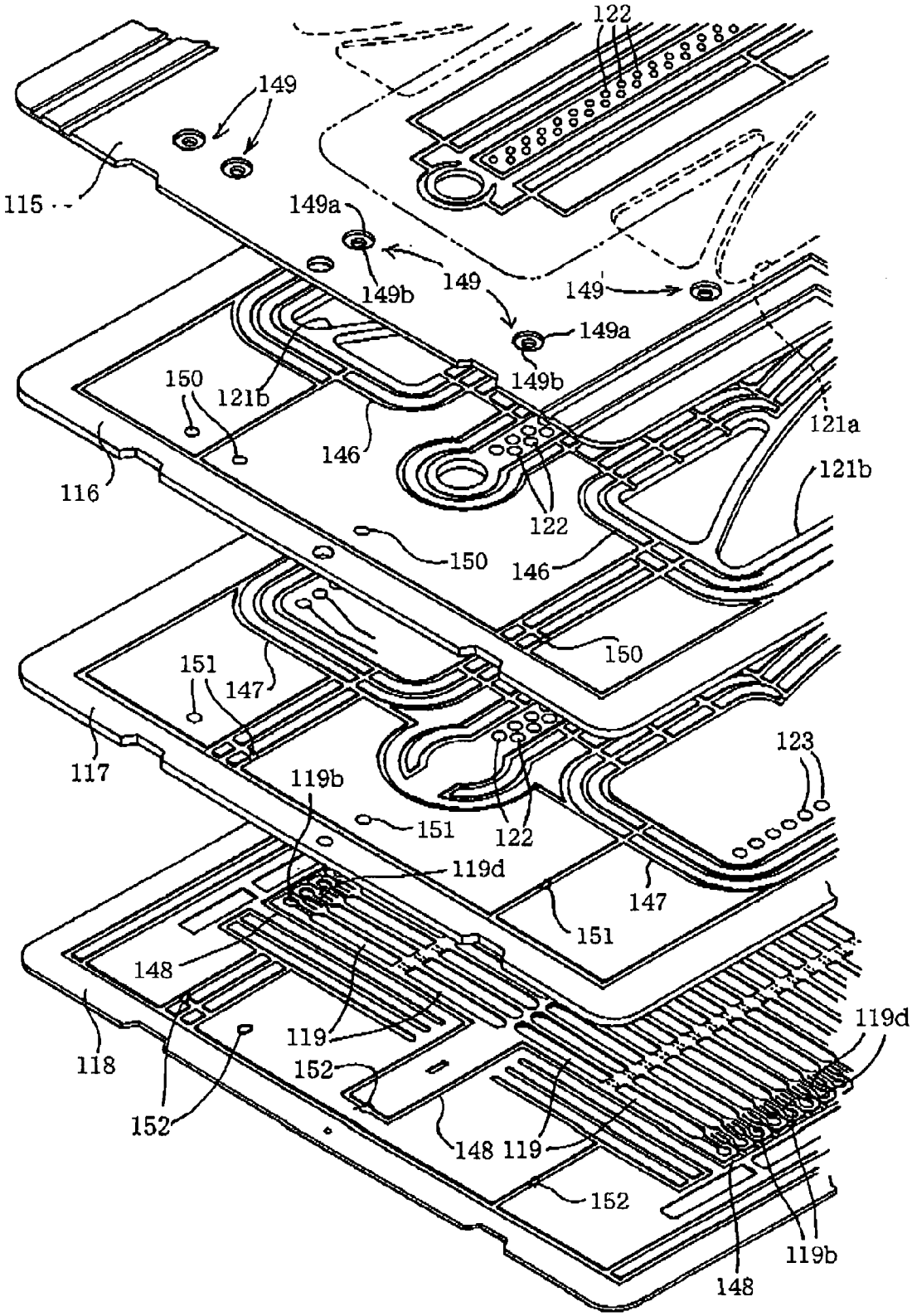
FIG. 14 is an exploded, perspective view of the channel unit shown in FIG. 9, with a base sheet being positioned at the bottom of the channel unit.
Figure 15:
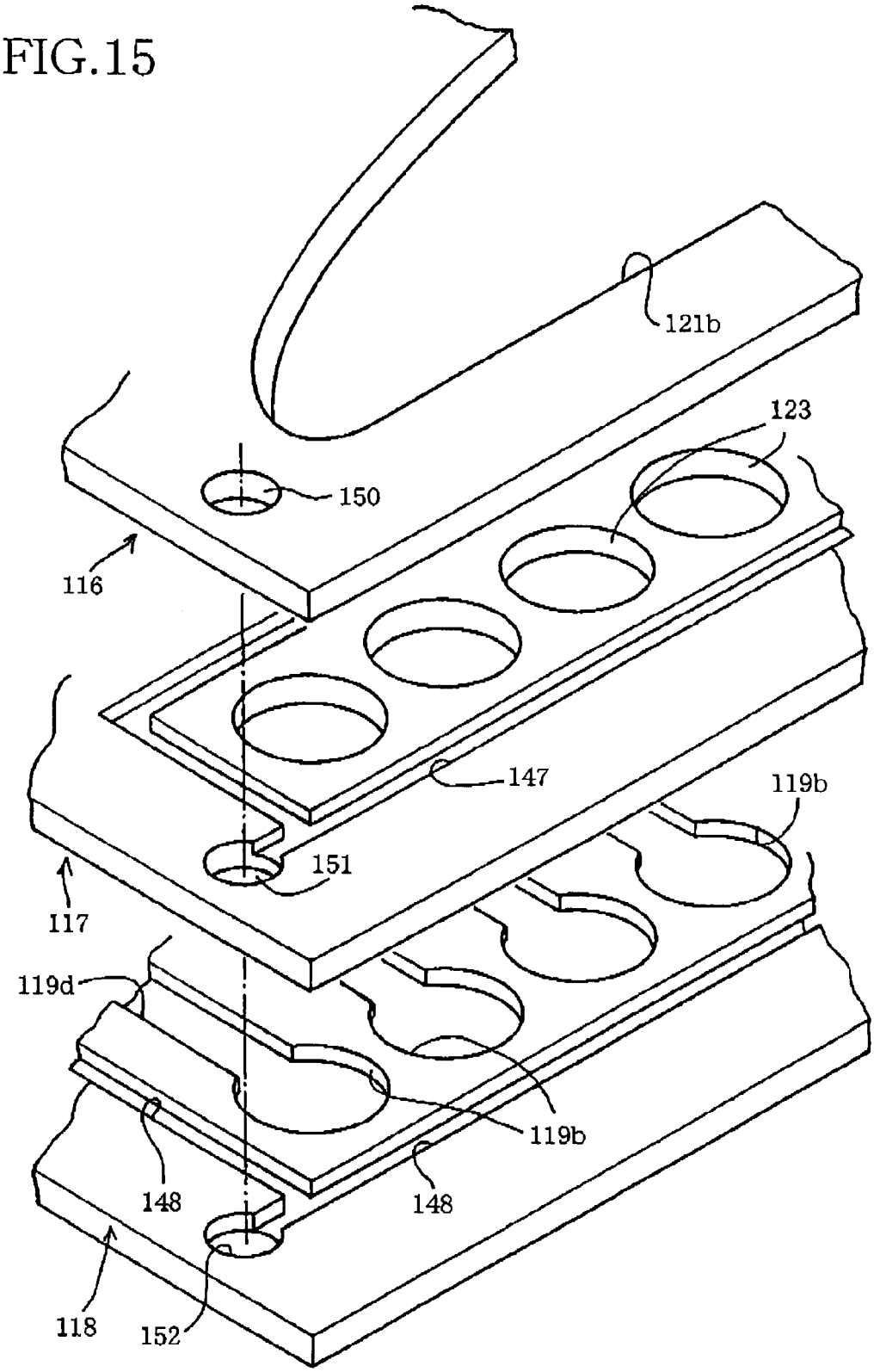
FIG. 15 is an exploded, enlarged, partly cut away, perspective view showing relief grooves and air relief holes formed in sheet members of the channel unit of FIG. 9.

As shown in FIGS. 14 and 15, at least one of respective major, contact surfaces of each pair of adjacent sheet members 115 and 116, 116 and 117, or 117 and 118 that are located adjacent each other in a direction of stacking of the lead frames 141*a* through 141*d*, has narrow relief grooves 146, 147, or 148, respectively, along locations where the adhesive is applied, such that the relief grooves 146, 147, 148 are separate outward from the corresponding ink-channel patterns such as the communication passages 122 or the common ink passages 121*a*, 121*b*. In the present embodiment, one major surface of the base sheet 118, positioned at the bottom when the channel unit 111 is assembled (hereinafter, referred to as the bottom sheet member 118, where appropriate), one major surface of the spacer sheet 117, placed on the base sheet 118, and one major surface of the second manifold sheet 116, placed on the spacer sheet 117, have relief grooves 148, relief grooves 147, and relief grooves 146, respectively, each of which has a depth substantially equal to half the thickness of each of the sheet members 118, 117, 116.

In addition, the sheet members 115, 116, 117, except for the bottom sheet member 118, have air relief holes 149, air relief holes 150, and air relief holes 151, respectively, which are formed through the respective thickness of the sheet members 115 through 117 and which communicate with the relief grooves 146, the relief grooves 147, and the relief grooves 148, respectively. The relief holes 149, the relief holes 150, and the relief holes 151 are aligned with each other in the direction of stacking of the sheet members 115 through 118.

Figure 16A:
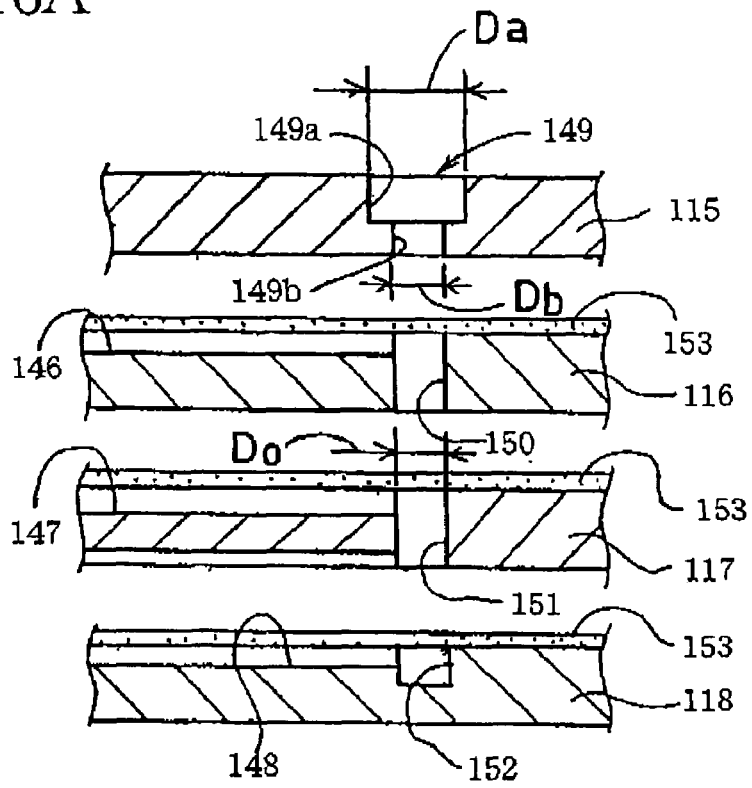
FIG. 16A is a cross-sectional view showing a manner in which an adhesive is applied to the sheet members of the channel unit of FIG. 9 before the sheet members are stacked on each other.
Figure 16B:
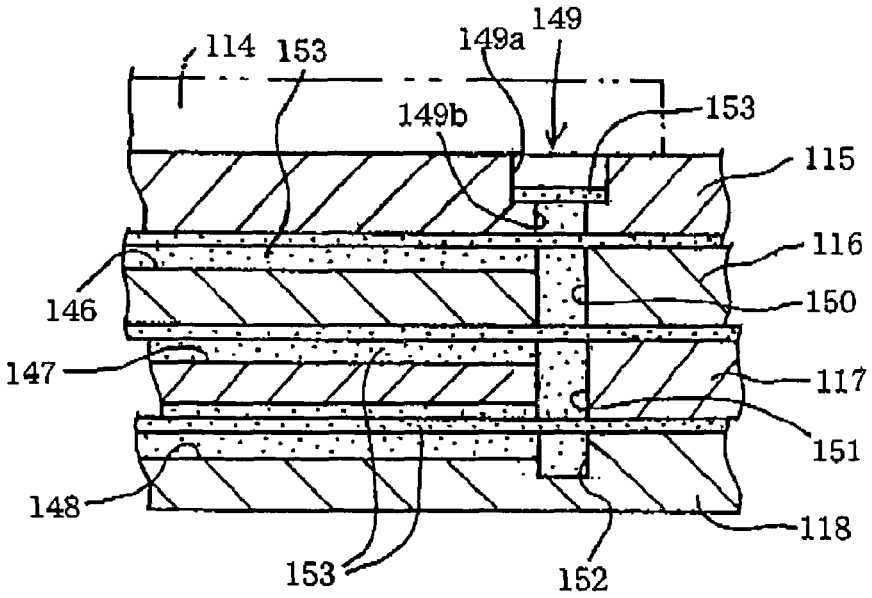
FIG. 16B is a cross-sectional view showing a manner in which the sheet members of the channel unit of FIG. 9 are stacked on, and adhered to, each other.

As shown in FIGS. 14, 16A, and 16B, each of the relief holes 149 of the first manifold sheet 115, positioned at the top when the channel unit 111 is assembled (hereinafter, referred to as the top sheet member 115, where appropriate), has a stepped shape including a small-diameter portion 149*b* having a small inner diameter Db on the side of the contact surface of the first manifold sheet 115, and additionally including a large-diameter portion 149*a* having a large inner diameter Da than the inner diameter Db, on the side of an outer or upper surface of the first manifold sheet 115. The inner diameter Da of the large-diameter portion 149*a* of each of the relief holes 149 is larger than not only the inner diameter Db of the small-diameter portion 149*b* of the each relief hole 149 but also an inner diameter Do of each of the relief holes 150, 151 formed in the other sheet members 116, 117 and a width of each of the relief grooves 146, 147, 148. The inner diameter Db of the small-diameter portion 149*b* of each relief hole 149 is substantially equal to the inner diameter Do of each of the relief holes 150, 151 of the other sheet members 116, 117.

As shown in FIGS. 16A and 16B, the bottom sheet member 118 has recessed holes 152 which do not extend through the thickness thereof or do not reach an outer or lower surface thereof and which have a depth substantially equal to the depth of the relief grooves 148 thereof, i.e., half the thickness thereof. In other words, respective lower ends of the holes 152 of the bottom sheet member 118 are closed. The recessed holes 152 of the bottom sheet member 118 are aligned with the relief holes 151, 150, 149 of the other sheet members 117, 116, 115 in the direction of stacking of the sheet members 118 through 115.

The channel unit 111 is assembled, i.e., the four sheet members 115 through 118 are stacked on, and fixed to, each other, as follows: First, a single thin metal sheet (e.g., a rolled metal sheet) is worked, by, e.g., etching, into four sorts of lead frames 141*a* through 141*d* corresponding to the four sorts of sheet members 115 through 118. Subsequently, an adhesive material 153 is applied to each of respective major surfaces of the sheet members 116, 117, 118 that have the relief grooves 146, the relief grooves 147, and the relief grooves 148, respectively.

Then, two positioning pins projecting from a jig, not shown, are inserted, from underside, into the two positioning holes 145, 145 of each of the respective frame portions 52 of the four lead frames 141*a* through 141*d*, so that the four sort of lead frames 141*a* through 141*d* are stacked on each other in a prescribed order, while the four sorts of sheet members 115 through 118 arranged in the direction of stacking of the lead frames are positioned relative to each other.

In the present embodiment, the four lead frames 141*a* through 141*d* are stacked on each other, as shown in FIG. 13, in an order opposite to an order of arrangement of the four sheet members 115 through 118 of the channel unit 111 in use, i.e., in a state in which the ink ejection nozzles 120 face downward. Therefore, in a direction from the bottom, to the top, of the channel unit 11, the base sheet 118, the spacer sheet 117, and the second and first manifold sheets 116, 115 are stacked on each other in the order of description.

Thus, as shown in FIG. 16A, the first manifold sheet 115 as the top sheet member takes a posture in which the large-diameter portions 149*a* of the relief holes 149 open outward in the outer surface thereof, or upward in the direction of stacking of the lead frames 141*a* through 141*d*, and each of the other sheet members 116, 117, 118 takes a posture in which the corresponding relief grooves 146, 147, 148 formed in the upper surface thereof open upward in the stacking direction.

After the lead frames 141*a* through 141*d* are stacked on each other in the above-described order, a pinching force or a pressing force is exerted to the uppermost lead frame 141*d* and the uppermost lead frame 141*a*, so that the four sorts of sheet members 115 through 118, arranged in the direction of stacking of the lead frames 141*a* through 141*d*, are adhered, and thereby fixed, to each other. In the case where a thermosetting adhesive is used as the adhesive material 153, the stacked lead frames 141*a* through 141*d* are heated while being pinched or pressed.

When the sheet members 115 through 118 are pinched or pressed and are thereby bonded to each other, superfluous amounts of the adhesive material 153 may flow into the relief grooves 146 through 148, and further fill the air relief holes 149 through 151 and the recessed holes 152. Air, or air bubbles that is or are trapped in gaps left between the respective contact surfaces of each pair of adjacent sheet members 115 and 116, 116 and 117, or 117 and 118 that are located adjacent each other in the direction of stacking thereof, is or are mixed with the adhesive material 153, and moved with the adhesive material 153 through the relief grooves 146 through 148 that are horizontal, and the relief holes 149 through 151 and the recessed holes 152 that are vertical, so that the air or air bubbles come out of the stacked and adhered sheet members 115 through 118.

Thus, a stable, adhesive and sealing layer is formed of the adhesive material 153 free of the air or air bubbles, between the respective major, contact surfaces of each pair of adjacent sheet members 115 through 118 that are located adjacent each other in the stacking direction.

The inner diameters Da of the large-diameter portions 149*a* of the air relief holes 149 that open outward in the outer surface of the first manifold sheet 115 as the top sheet member are larger than the inner diameters Db of the small-diameter portions 149*b* of the relief holes 149. In other words, respective volumes of the large-diameter portions 149*a* communicating with ambient air are larger than respective volumes of the small-diameter portions 149*b*. Therefore, the superfluous amounts of the adhesive material 153 coming up to the outer or upper surface of the first manifold sheet 115 can be accommodated by the large-diameter portions 149*a*.

Thus, the adhesive material 153 can be effectively prevented from leaking to the outer surface of the first manifold sheet 115, and a wiping operation to wipe off the superfluous adhesive material 153 can be omitted.

Since the superfluous amounts of the adhesive material 153 coming up to the outer surface of the first manifold sheet 115 can be accommodated by the large-diameter portions 149*a* of the relief holes 149, the adhesive material 153 can be effectively prevented from leaking to an outer surface of the stacked sheet members 115 through 118 (i.e., the outer surface of the first manifold sheet 115), and a degree of planarity or flatness of the outer surface of the stacked sheet members can be kept equal to that of the outer surface of the first manifold sheet 115 immediately after being etched.

The nozzle sheet 114 is adhered to the first manifold sheet 115 as the top sheet member of the stacked sheet members 115 through 118, such that the ink ejection nozzles 120 are aligned with the communication passages 122, as shown in FIG. 12. The nozzle sheet 114 has dimensions which assure that in the state in which the nozzle sheet 114 is adhered to the first manifold sheet 115, the nozzle sheet 114 fully covers all the air relief holes 149. Therefore, when the ink jet printer head 110 is used, the ink adhered to the outer surface of the channel unit 111 is effectively prevented from entering the printer head 110 via the relief holes 149.

Since the large-diameter portions 149*a* prevent the adhesive material 153 from leaking to the outer surface of the first manifold sheet 115, a thickness of the adhesive material 153 applied to that surface so as to adhere the nozzle sheet 114 thereto can be made uniform and accordingly the nozzle sheet 114 can be appropriately adhered to the stacked sheet members 115 through 118. Thus, the ink jet printer head 110 as a final product is freed of various problems such as ink leakage.

In addition, since the degree of flatness of the outer or upper surface of the stacked sheet members 115 through 118 can be kept intact, the nozzle sheet 114 can be freed of warpage or inclination and the ink jet recording head 110 as the final product can enjoy an excellent ink ejection performance.

Because of the above-indicated reasons, the yield of the ink jet printer heads 110 as the final products is improved.

The liquid adhesive material 153 moves, by capillarity, in the small gaps left between the respective contact surfaces of each pair of adjacent sheet members 115 through 118 located adjacent each other in the stacking direction. Therefore, the adhesive material 153 is more strongly attracted by gaps having small cross sections than gaps having large cross sections. Since the relief grooves 146 through 148 have the smaller cross sections than those of the ink channels such as the communication passages 122 or the through-holes 123, the adhesive material 153 provided between the respective contact surfaces of each pair of adjacent sheet members 115 through 118 can be more strongly attracted by the relief grooves 146 through 148 than the ink channels, so that the adhesive material 153 can be introduced into the air relief holes 149 through 151 and the recessed holes 152. Thus, the ink channels can be effectively prevented from being clogged by the adhesive material 153.

After the sheet members 115 through 118 are adhered, and thereby fixed, to each other, a tool, not shown, such as a punch is used to press downward, or punch, the bridge portions 143, so that the stacked and adhered sheet members 115 through 118 are separated from the frame portions 142 of the lead frames 141*a* through 141*d*. Subsequently, the nozzle sheet 114 is fixed, with the adhesive material 153, to the outer surface of the stacked sheet members, i.e., the outer surface of the first manifold sheet 115. Thus, the channel units 111 each having the sheet-stacked structure is obtained.

Since the outer surface of the first manifold sheet 115 is free of unevenness resulting from hardening of the adhesive material 153, that is, the degree of flatness of the outer surface of the stacked sheet members 115 through 118 is high, the nozzle sheet 114 can appropriately close the large-diameter portions 149*a* of the air relief holes 149 of the first manifold sheet 115 when the nozzle sheet 114 is adhered and fixed to the same 115. Thus, the large-diameter portions 149*a* of the air relief holes 149 can be appropriately closed by the nozzle sheet 114, without using an exclusive sealing material.

Thus, the ink jet printer head 110 can be produced with a decreased number of parts or components and in a decreased number of working steps, and the production cost of the printer head 110 can be decreased.

Figure 17A:
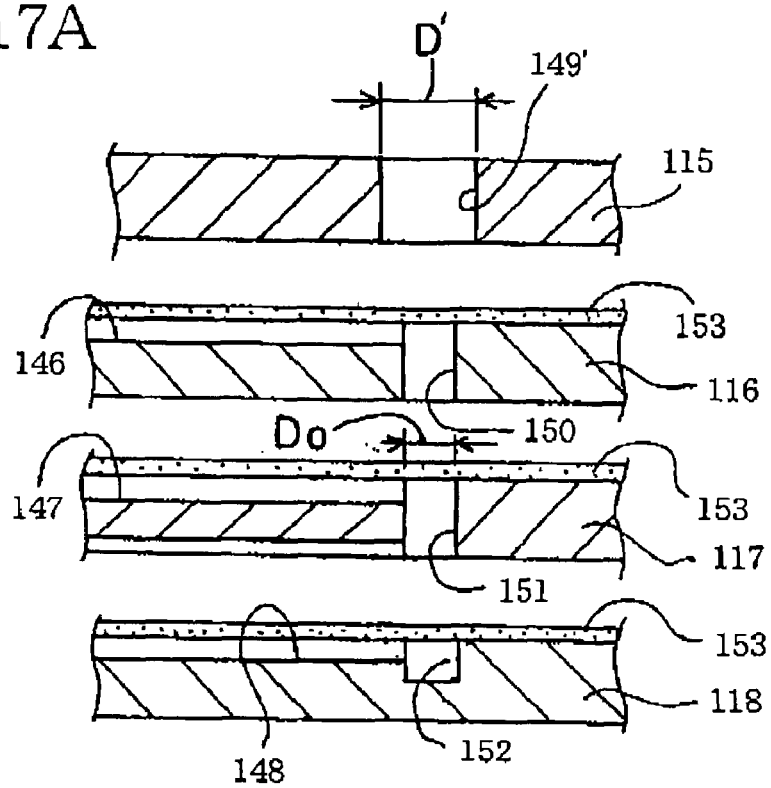
FIG. 17A is a cross-sectional view showing a manner in which an adhesive is applied to sheet members of another channel unit as another embodiment of the present invention before the sheet members are stacked on each other.
Figure 17B:
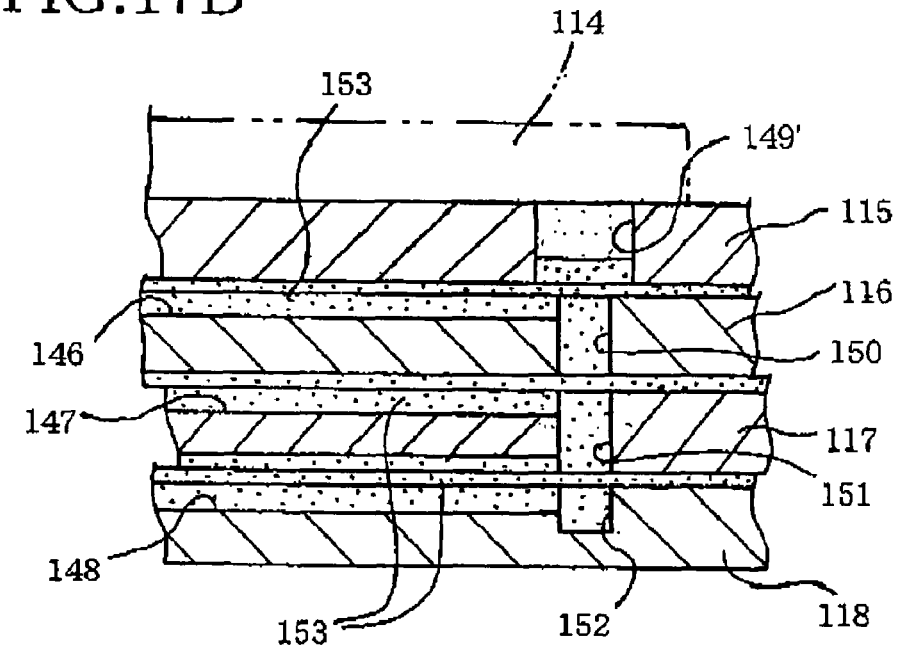
FIG. 17B is a cross-sectional view showing a manner in which the sheet members of the channel unit shown in FIG. 17A are stacked on, and adhered to, each other.

FIGS. 17A and 17B shows a modified embodiment of the second embodiment shown in FIGS. 9 through 15, 16A, and 16B. The modified embodiment relates to another sheet-member stacked and adhered structure wherein a first manifold sheet 115 as a top sheet member of a plurality of stacked sheet members 115, 116, 117, 118 has air relief holes 149' differing from the air relief holes 149 employed by the second embodiment shown in FIGS. 16A and 16B. The same reference numerals as used in the second embodiment are used to designate the corresponding elements of the modified embodiment, and the description of those elements is omitted.

In the modified embodiment, the air relief holes 149' of the first manifold sheet 115 have an inner diameter D' larger than at least an inner diameter Do of air relief holes 150 of the second manifold sheet 116 located below a lower surface of the first manifold sheet 115 in a direction of stacking of the sheet members 115 through 118. In the modified embodiment, air relief holes 151 of the spacer sheet 117, and recessed holes 152 of the base sheet 118 have the same inner diameter Do. Thus, in the modified embodiment, each air relief hole 149' as a whole functions like the large-diameter portion 149*a* of each air relief hole 149 employed in the second embodiment shown in FIGS. 16A and 16B.

Therefore, also in the modified embodiment, superfluous amounts of an adhesive material 153 coming up to an outer surface of the first manifold sheet 115 can be accommodated by the large-diameter air relief holes 149' of the same 115. Thus, the superfluous amounts of the adhesive material 153 can be effectively prevented from leaking to the outer surface of the first manifold sheet 115, like in the second embodiment shown in FIGS. 16A and 16B.

Meanwhile, as shown in FIGS. 9 and 12, the piezoelectric actuator 112 includes a plurality of piezoelectric ceramic sheets 127 which are stacked on each other and each of which has a thickness of about 30 μm.

An individual-electrode layer, i.e., two arrays of individual electrodes, not shown, each having a small width are provided, on a major, upper surface of each of every second piezoelectric sheets 127 that are counted upward from the bottom sheet 127, at respective positions corresponding to the pressure chambers 119 of the channel unit 111, such that the two arrays of individual electrodes extend in a lengthwise direction of the piezoelectric actuator 112, i.e., in the X-axis direction. In addition, a common electrode, not shown, which is common to all the pressure chambers 119 is provided on a major, upper surface of each of the other piezoelectric sheets 127. The individual electrodes of each one of the individual-electrode layers are aligned with the individual electrodes of the other individual-electrode layers, in the direction of stacking of the piezoelectric sheets 127, and the two arrays of individual electrodes of all the individual-electrode layers cooperate with the common electrodes to sandwich two arrays of active portions of each one of the piezoelectric sheets 127, in the direction of stacking of the same 127. Those active portions of the piezoelectric sheets 127 are deformed by longitudinal piezoelectric effect.

As shown in FIG. 9, on an upper surface of the uppermost piezoelectric sheet 127, there are provided two arrays of external individual electrodes 128 that are electrically connected to the two arrays of individual electrodes of each one of the individual-electrode layers, and four external common electrodes 129 that are electrically connected to each one of the common electrodes.

As shown in FIG. 12, an adhesive sheet 130 formed of an ink-impermeable synthetic resin as a sort of adhesive material, or a thermosetting adhesive material as another sort of adhesive material is adhered or applied, in advance, to an entire lower surface of the sheet-stacked-type piezoelectric actuator 112 that is to be opposed to the pressure chambers 119 of the channel unit 111. Subsequently, in a state in which the individual electrodes of the piezoelectric actuator 112 are aligned with the corresponding pressure chambers 119 of the channel unit 111, the piezoelectric actuator 112 is adhered, and thereby fixed, to the upper surface of the channel unit 111.

The flexible flat cable 113 is stacked on, and bonded to, an upper surface of the piezoelectric actuator 112, such that respective electric wires, not shown, of the flat cable 113 are electrically connected to the individual and common external electrodes 128, 129 of the piezoelectric actuator 112.

In the ink jet printer head 110 constructed as described above, when an electric voltage is applied to arbitrary ones of the individual electrodes that are aligned with each other in the direction of stacking of the piezoelectric sheets 127 and are opposed to a corresponding one of the pressure chambers 119, and the common electrodes, of the piezoelectric actuator 112, the active portions corresponding to the arbitrary individual electrodes are deformed, by the longitudinal piezoelectric effect, in the direction of stacking of the piezoelectric sheets 127. Since this deformation decreases a volume of the pressure chamber 119 corresponding to the arbitrary individual electrodes, a droplet of ink is ejected from the ink ejection nozzle 24 communicating with the pressure chamber 119, and a desired image is recorded on a recording medium such as a sheet of paper.

The present invention is not limited to the illustrated embodiments, but can be embodied in various manners. For example, although, in each of the embodiment shown in FIGS. 16A and 16B and the embodiment shown in FIGS. 17A and 17B, the present invention is applied to the manufacturing of the ink jet printer head 110, the present invention is also applicable to the manufacturing of an electronic component or device.

In addition, although, in each of the embodiment shown in FIGS. 16A and 16B and the embodiment shown in FIGS. 17A and 17B, the lead frames 141*a* through 141*d*, or the sheet members 115 through 118 are stacked on each other in the order opposite to the order in which the sheet members 115 through 118 are arranged in the channel unit 111 in use such that the nozzles 120 open in the lower surface of the unit 111. However, the lead frames 141*a* through 141*d*, or the sheet members 115 through 118 may be stacked on each other in such an order in which the first manifold sheet 115 provides the bottom sheet member and the base sheet 118 provides the top sheet member, i.e., the same order as the order of arrangement of the sheet members 115 through 118 in the channel unit 111 in use. In the latter case, the base sheet 118 as the top sheet member is so formed as to have, in place of the recessed holes 152, air relief through-holes which are formed through the thickness of the base sheet 118 and have a stepped shape including a small-diameter portion located on the side of its contact surface, i.e., its the lower surface in the stacking direction and a large-diameter portion located on the side of its outer or upper surface, or have an inner diameter larger than at least the inner diameter Do of the air relief holes 151 of the spacer sheet 117 located below the base sheet 118. In addition, the first manifold sheet 115 as the bottom sheet member is so formed as to have, in place of the air relief through-holes 149, recessed holes that are not through-holes but bottomed holes. In addition, the piezoelectric actuator 112 is so formed as to have dimensions which assure that the actuator 112 can fully cover the air relief through-holes of the base sheet 118, so as to prevent foreign matters such as ink from entering the channel unit 111 via those through-holes.

Hereinafter, there will be described a third embodiment of the present invention, by reference to FIGS. 18 through 22. First, a piezoelectric-type ink jet printer head 200 to which the present invention is applied will be briefly described by reference to FIGS. 18 through 20.

Figure 18:
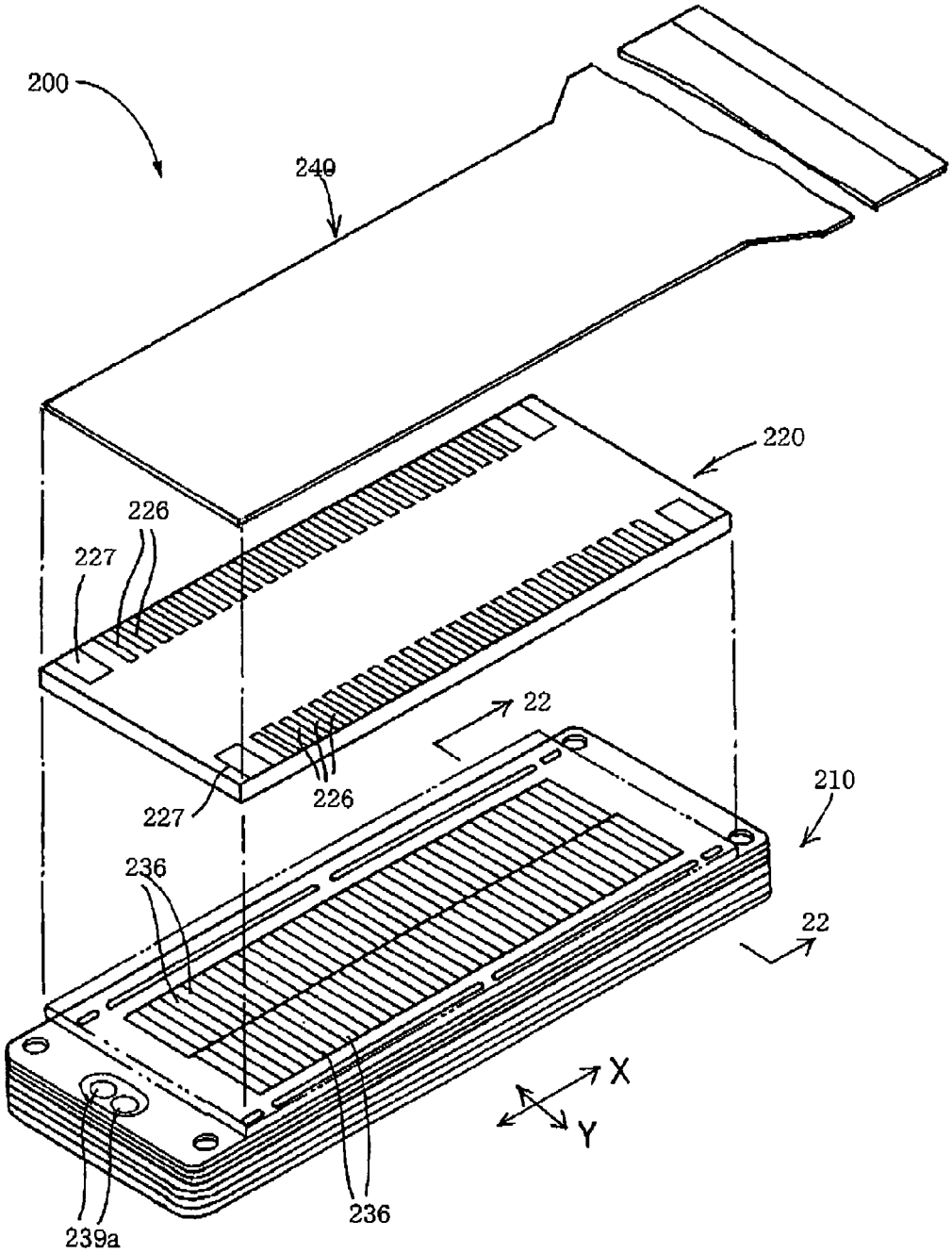
FIG. 18 is a perspective view of another piezoelectric ink jet printer head to which the present invention is applied, a channel unit, a piezoelectric actuator, and a flexible flat cable of the printer head being separated from each other for illustrative purposes only.

As shown in FIG. 18, the piezoelectric ink jet printer head 200 includes a channel unit 210 constituted by a plurality of metal sheets; a sheet-stacked-type piezoelectric actuator 220 stacked on, and bonded to, an upper surface of the channel unit 210; and a flexible flat cable 240 stacked on, and bonded to, an upper surface of the piezoelectric actuator 220, for electrically connecting the piezoelectric actuator 220 to an external device, not shown. The ink jet printer head 200 ejects a droplet of ink in a downward direction from each of a plurality of ink ejection nozzles 235 (FIG. 19) that open in a lower surface of the channel unit 210 as the lowermost layer of the printer head 200.

Figure 19:
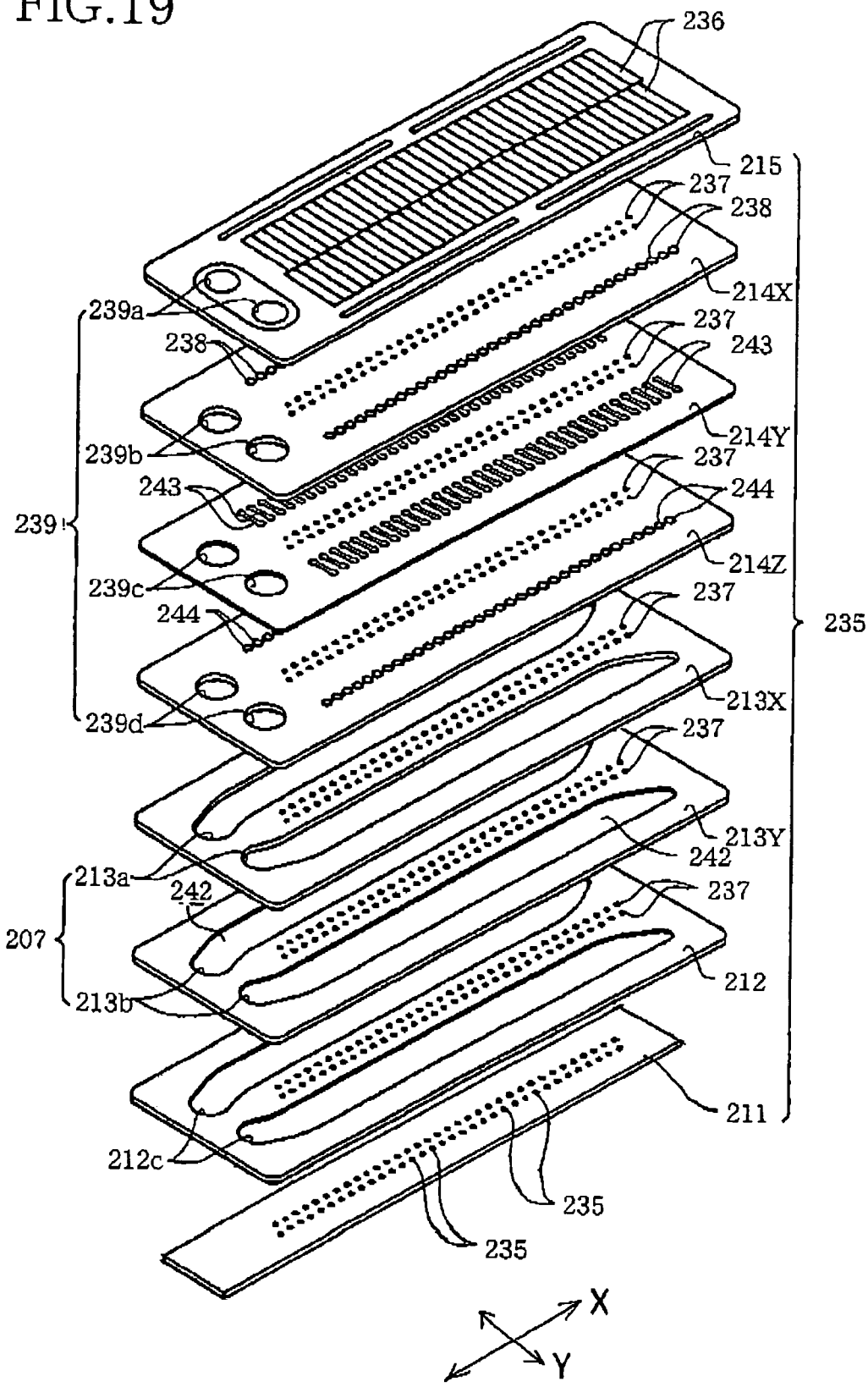
FIG. 19 is an exploded, perspective view of the channel unit shown in FIG. 18.
Figure 20:
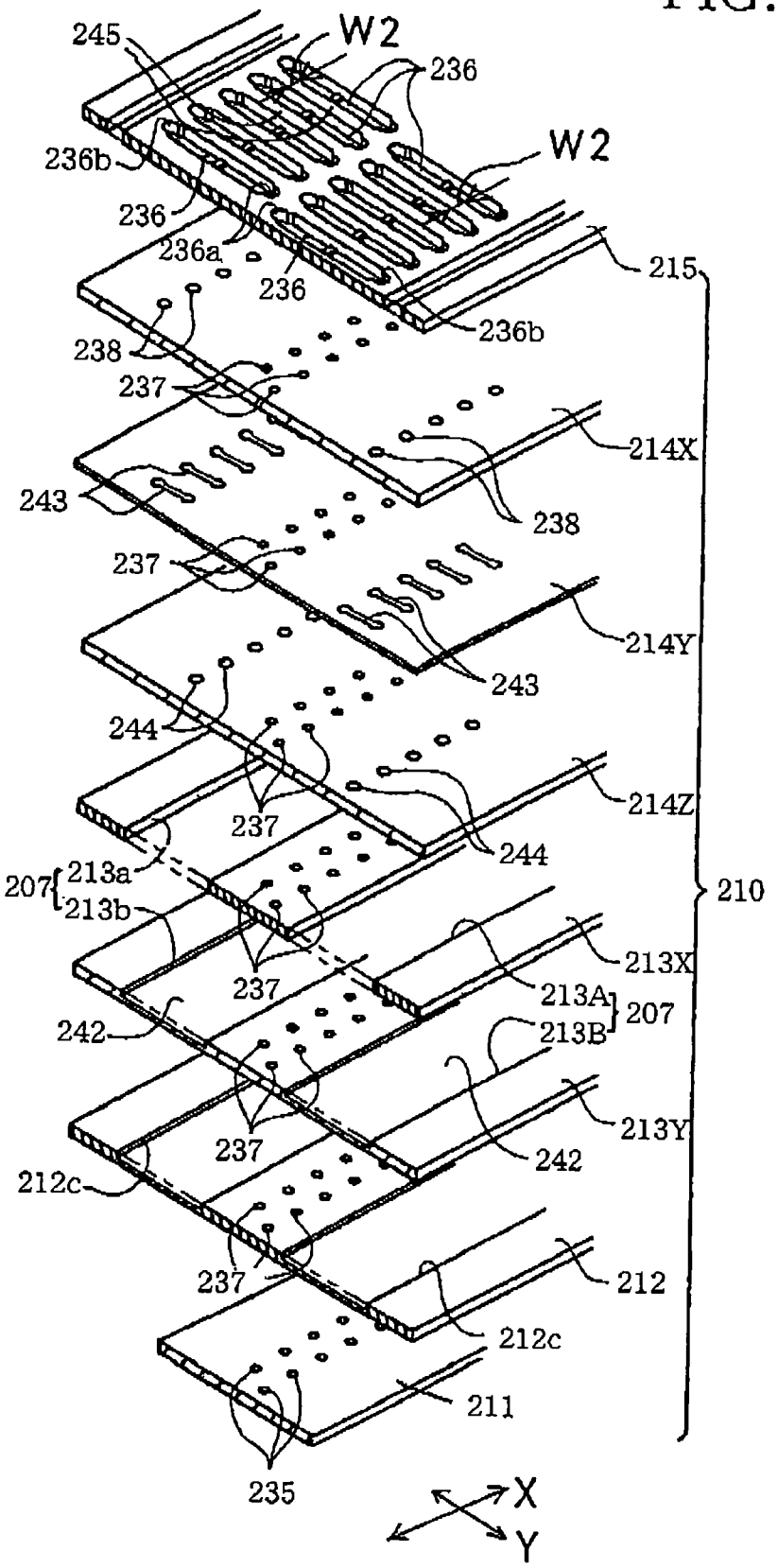
FIG. 20 is an exploded, enlarged, perspective view of a portion of the channel unit of FIG. 18.

As shown in FIGS. 19 and 20, the channel unit 210 has a sheet-stacked structure in which eight thin sheets are stacked on each other, and are bonded to each other with an adhesive. More specifically described, the channel unit 210 includes a nozzle sheet 211, a damper sheet 212, two manifold sheets 213X, 213Y, three spacer sheets 214X, 214Y, 214Z, and a base sheet 215.

In the present embodiment, the seven sheet members 212, 213X, 213Y, 214X, 214Y, 214Z, 215, except for the nozzle sheet 211, are each formed of a 42% nickel alloy steel sheet, and have respective thickness values each falling in the range of from about 50 μm to about 150 μm. The nozzle sheet 211 is formed of a synthetic resin. The nozzle sheet 211 has two arrays of ink ejection nozzles 235 that are arranged in a staggered or zigzag fashion, at a regular small interval of distance, in a first direction (i.e., a lengthwise direction or an X-axis direction) of the channel unit 210 or the printer head 200. Each of the ink ejection nozzles 235 is formed through the thickness of the nozzle sheet 211, and has a small diameter of, e.g., about 25 μm.

As shown in FIG. 20, the base sheet 215 has a plurality of pressure chambers 236 that are formed through a thickness thereof such that each of the pressure chambers 236 is elongate in a second direction (i.e., a widthwise direction or a Y-axis direction) of the channel unit 210 or the printer head 200 that is perpendicular to the first direction (i.e., the lengthwise direction or the X-axis direction) of the unit 210 or the head 200. As shown in the figure, the pressure chambers 236 are arranged in two arrays in a zigzag fashion in the first direction.

Respective inner end portions 236*a* of the pressure chambers 236 are located in a middle portion of the base sheet 215 in the second direction or the Y-axis direction, and communicate with the respective ink ejection nozzles 235 of the nozzle sheet 211, via respective small-diameter through-holes 237 as respective parts of a plurality of ink channels that are formed in a zigzag fashion through a thickness of each of the three spacer sheets 214X, 214Y, 214Z, the two manifold sheets 213X, 213Y, and the damper sheet 212.

As shown in FIG. 20, the upper manifold sheet 213X located adjacent a lower surface of the spacer sheet 214Z has two common half chambers 213*a*, 213*a* that are formed through a thickness of the sheet 213X, such that the two common half chambers 213*a*, 213*a* extend along, and outside, the two arrays of ink ejection nozzles 235, respectively, i.e., in the first direction of the channel unit 210. On the other hand, the lower manifold sheet 213Y located adjacent an upper surface of the nozzle sheet 211 has two common half chambers 213*b*, 213*b* that open in only an upper surface of the sheet 213Y, are aligned with the two common half chambers 213*a*, 213*a*, respectively, and have substantially the same plan-view shape as that of the common half chambers 213*a*, 213*a*.

As shown in FIG. 20, in a state in which the upper and lower manifold sheets 213X, 213Y are stacked on each other and the lower spacer sheet 214Z is stacked on the upper manifold sheet 213Y, each of the two common half chambers 213*a*, 213*a* cooperates with a corresponding one of the two common half chambers 213*b*, 213*b* to define a corresponding one of two common manifold chambers 207, 207 that are located outside the two arrays of through-holes 237, respectively. The two common manifold chambers 207, 207 are fluid-tightly closed by the lower spacer sheet 214Z stacked on the upper manifold sheet 213X.

Figure 21:
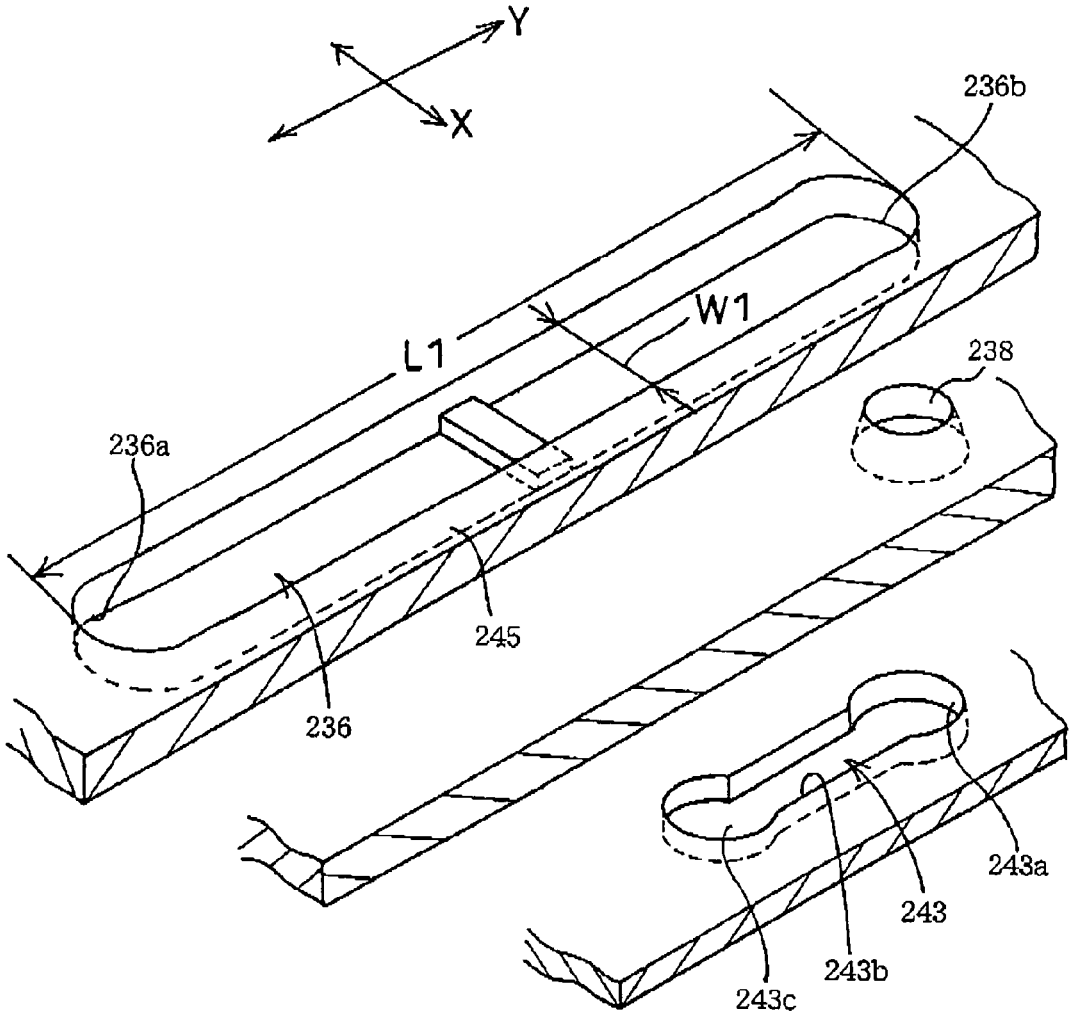
FIG. 21 is an exploded, enlarged, perspective view showing a pressure chamber and a connection passage of the channel unit of FIG. 18.

Respective outer end portions 236*b* of the pressure chambers 236 communicate with the common manifold chambers 207 via two arrays of communication holes 238 that are formed through a thickness of the upper spacer sheet 214X located adjacent a lower surface of the base sheet 25, two arrays of connection passages 243 formed through a thickness of the intermediate spacer sheet 214Y, and two arrays of introduction holes 244 formed through a thickness of the lower spacer sheet 214Z. The communication holes 238, the connection passages 243, and the introduction holes 244 provide parts of the ink channels. In the present embodiment, as shown in FIGS. 20 and 21, each of the pressure chambers 236 is long in a direction (hereinafter, referred to as the lengthwise direction) parallel to a reference line connecting between its inner end portion 236*a* communicating with the corresponding nozzle 235, and its outer end portion 236*b* communicating with the corresponding common manifold chamber 207, and is short in a direction (hereinafter, referred to as the widthwise direction) perpendicular to the lengthwise direction. In the embodiment shown in FIG. 21, each pressure chamber 236 has a length L1 of about 4 mm in its lengthwise direction, and a width W1 of about 0.25 mm in its widthwise direction. As shown in FIG. 20, a partition wall 245 located between each pair of adjacent pressure chambers 236 that are located adjacent each other in the X-axis direction has a thickness W2 of about 0.1 mm in the same direction.

A direction in which the thin metal sheet constituting the base sheet 215 is rolled is parallel to the widthwise direction or Y-axis direction of the channel unit 210 that is perpendicular to the lengthwise direction or X-axis direction of the channel unit 210 in which the pressure chambers 236 are arranged in the two arrays. That is, the direction of rolling of the base sheet 215 is parallel to the lengthwise direction of each of the pressure chambers 236, i.e., the lengthwise direction of each of the partition walls 245.

Since the direction of rolling of the base sheet 215 is parallel to the lengthwise direction of each pressure chamber 236 or each partition wall 245, the ink jet printer head 200 enjoys the following advantages:

When a thin metal sheet is produced by rolling, the produced metal sheet is likely to have, in opposite major surfaces thereof, rolling marks or streaks that extend in the rolling direction. Thus, the rolling streaks have irregularity in a direction perpendicular to the rolling direction. In other words, the rolling streaks include microgrooves and microridges, shown in FIG. 23, that extend in the rolling direction. Therefore, the partition wall 245 located between each pair of adjacent pressure chambers 236 has, in the opposite surfaces of the wall 245, the rolling streaks extending parallel to the lengthwise direction of the wall 245, and it do not continuously connect between the two adjacent chambers 236.

Thus, the upper spacer sheet 214X is bonded with an adhesive to the lower surface of the base sheet 215, and the piezoelectric actuator 220 is stacked on, and bonded with the adhesive to, the upper surface of the base sheet 125, such that the lengthwise direction of each of the partition walls 245 is parallel to the lengthwise direction of the rolling streaks of the base sheet 215. Therefore, even if the thickness of the adhesive layer provided on each of the opposite surfaces of each partition wall 245 may not be uniform because of the presence of microgrooves of the rolling streaks, the adhesive layer includes no portions whose thickness is very small or even zero and which continuously connect between the two adjacent pressure chambers 236. In other words, there are produced, on each of the opposite surfaces of each partition wall 245, no gaps or spaces that communicate the two adjacent pressure chambers 236 with each other. Therefore, no ink leakage occurs between the two, adjacent pressure chambers 236, and a droplet of ink is ejected from a desired ink ejection nozzle 235 only, so that an image is recorded at an appropriate position on recording medium. Thus, the image can be recorded with high accuracy.

Each of the pressure chambers 236 is supplied with the ink from a corresponding one of the two manifold chambers 207 (213*a*, 213*b*) via a corresponding one of the connection passages 243. As shown in FIG. 21, each connection passage 243 includes an inlet hole 243*c* for receiving the ink supplied from the corresponding manifold chamber 207; an outlet hole 243*a* communicating with the corresponding pressure chamber 236; and a restrictor portion 243*b* that is provided between the inlet and outlet holes 243*c*, 243*a* and has a small cross-section area assuring that the restrictor portion 243*b* exhibits the greatest resistance to the flow of ink, in the each connection passage 243.

In the present embodiment, the intermediate spacer sheet 214Y located adjacent the lower surface of the upper spacer sheet 214X has the two arrays of connection passages 243 each of which extends parallel to the upper and lower surfaces of the sheet 214Y and substantially parallel to the lengthwise direction of a corresponding one of the pressure chambers 236. The lower spacer sheet 214Z has the two arrays of introduction holes 244 each of which is formed through a thickness of the sheet 214Z so as to communicate the inlet hole 243*c* of a corresponding one of the connection passages 243, with a corresponding one of the two manifold chamber 207.

Figure 22:
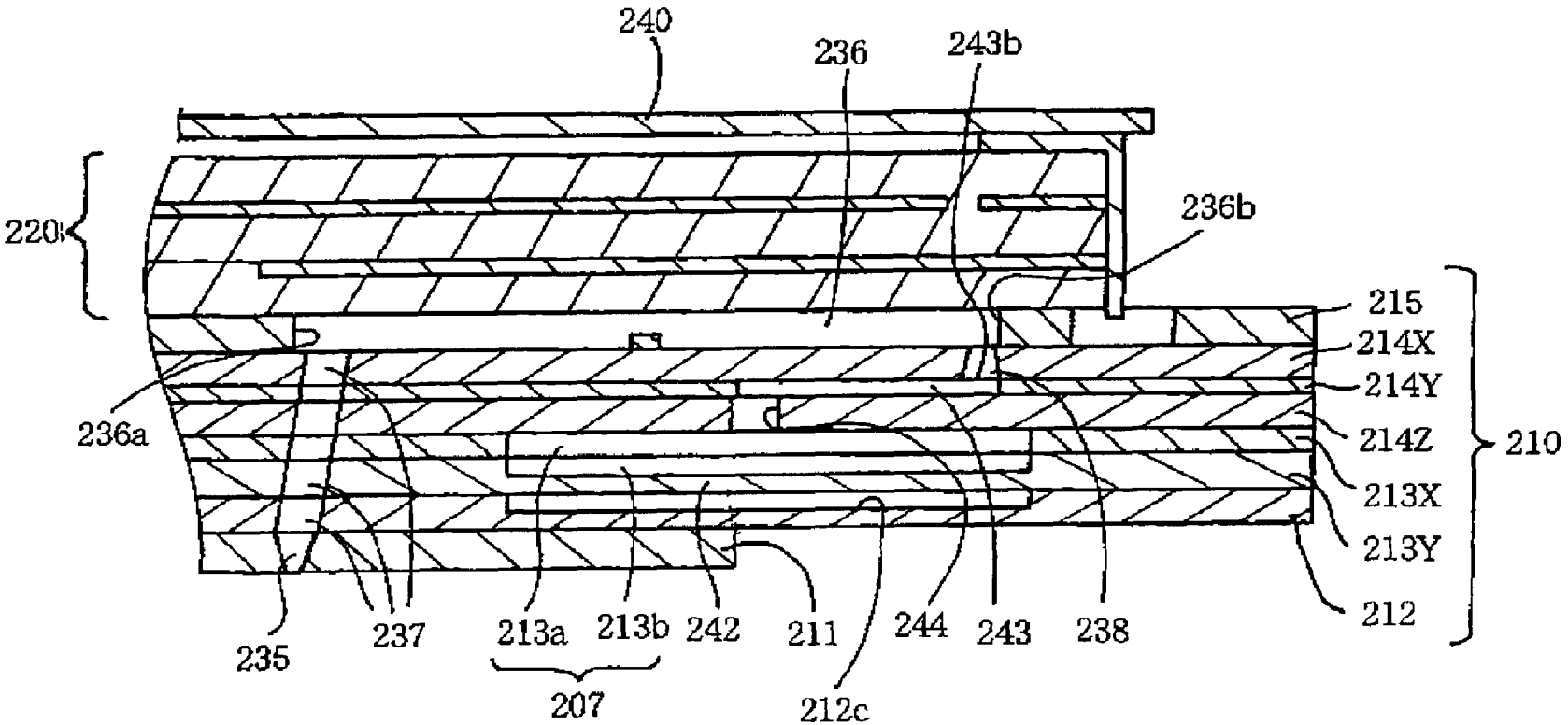
FIG. 22 is an enlarged, cross-sectional view taken along 22-22 in FIG. 18.

As shown in FIGS. 20 and 22, the damper sheet 212 provided right below the lower manifold sheet 213Y has two damper chambers 212*c*, 212*c* that open in only an upper surface of the sheet 212 so as to face the lower manifold sheet 213Y, are aligned with the two manifold chambers 207, 207, respectively, and have the same plan-view shape as that of the manifold chambers 207, 207.

Therefore, when the two manifold sheets 213X, 213Y and the damper sheet 212 are bonded to each other, the two damper chambers 212*c*, 212*c* are provided right below two bottom portions or walls (i.e., two damper portions or walls 242) of the lower spacer sheet 213Y that define the two half common chambers 213*b*, 213*b* thereof, respectively. Since the lower manifold sheet 213Y is constituted by the thin metal sheet that can be elastically deformed by an appropriate amount, each of the two damper walls 242 can freely oscillate toward both a corresponding one of the two manifold chambers 207 and a corresponding one of the two damper chambers 212*c*, 212*c*. Owing to this structure, even if an arbitrary one of the two manifold chambers 207 may receive, when an ink ejecting operation, described later, is carried out, a pressure change produced in an arbitrary one of the pressure chambers 236, a corresponding one of the two damper walls 242 is elastically deformed, and oscillated, so that the pressure change may be absorbed and attenuated by a damping effect of the one damper wall 242, and accordingly may be prevented from being transmitted to the other pressure chambers 236, i.e., cross-talking with the same 236.

As shown in FIG. 19, each of the base sheet 215 and the three spacer sheets 214X, 214Y, 214Z has two ink supply holes 239 (239*a*, 239*b*, 239*c*, 239*d*) that are formed through the thickness thereof, at respective positions corresponding to respective lengthwise end portions of the two manifold chambers 207, 207, and receive respective inks from, e.g., two external ink cartridges or tanks. Therefore, the respective lengthwise end portions of the manifold chambers 207, 207 that are located on the side of the ink supply holes 239*a* through 239*d* are respective upstream-side end portions of the same 207, 207 with respect to the respective flows of inks. As shown in FIGS. 20 and 21, the inks supplied to the two manifold chambers 207, 207 are distributed to the respective outer end portions 236*b* of the pressure chambers 236 via the respective introduction holes 244 of the lower spacer sheet 214Z, the respective connection passages 243, and the respective communication passages 238. Then, when the piezoelectric actuator 220 is driven or operated, the inks are delivered from the pressure chambers 236 to the corresponding ink ejection nozzles 235 via the respective through-holes 237, as will be described later.

As shown in FIG. 22, the piezoelectric actuator 220 includes a plurality of piezoelectric sheets and a top sheet which are stacked on each other, and each of the piezoelectric sheets has a thickness of about 30 μm. Two arrays of internal individual electrodes, not shown, each having a small width are provided, on an upper, major surface of the lowermost piezoelectric sheet, at respective positions corresponding to the pressure chambers 236 of the channel unit 210, such that the two arrays of internal individual electrodes extend in a lengthwise direction of the piezoelectric actuator 220, i.e., in the X-axis direction, and such that the internal individual electrodes of each of the two arrays extend in a widthwise direction of the actuator 220, i.e., the Y-axis direction perpendicular to the X-axis direction so as to reach a corresponding one of two widthwise opposite ends of the bottom or lowermost piezoelectric sheet. In addition, an internal common electrode which is common to all the pressure chambers 236 is provided on an upper, major surface of the second piezoelectric sheet counted in an upward direction from the lowermost piezoelectric sheet. As shown in FIG. 18, on an upper surface of the top or uppermost sheet, there are provided, along two widthwise opposite ends of the top sheet, two arrays of external individual electrodes 226, respectively, such that the external individual electrodes 226 are electrically connected to the internal individual electrodes, respectively, and there are also provided external common electrodes 227 that are electrically connected to the internal common electrode.

However, the piezoelectric actuator 220 may be one which employs a greater number of piezoelectric sheets that are stacked on each other and which is disclosed by, e.g., Japanese Patent Application Publication No. 4-341853 or its corresponding U.S. Pat. No. 5,402,159.

An adhesive layer in the form of an adhesive sheet, not shown, formed of an ink-impermeable synthetic resin is adhered or applied, in advance, to an entire, lower, major surface of the sheet-stacked-type piezoelectric actuator 220, constructed as described above, that is to be opposed to the pressure chambers 236 of the channel unit 210. Subsequently, in a state in which the internal individual electrodes of the piezoelectric actuator 220 are aligned with the corresponding pressure chambers 236 of the channel unit 210, the piezoelectric actuator 220 is adhered, and thereby fixed, to the upper surface of the channel unit 210. In addition, the flexible flat cable 240 is stacked and pressed on an upper surface of the piezoelectric actuator 220, such that respective electric wires, not shown, of the flat cable 240 are electrically connected to the individual and common external electrodes 226, 227 of the piezoelectric actuator 220.

In the ink jet printer head 200 constructed as described above, when an electric voltage is applied to an arbitrary one of the internal individual electrodes, and the internal common electrode, of the piezoelectric actuator 220, an active portion (i.e., a pressure applying portion) of the piezoelectric sheet that is sandwiched by the arbitrary internal individual electrode and the internal common electrode in the direction of stacking of the sheets, is deformed, by piezoelectric effect, in the stacking direction. Since this deformation decreases a volume of the pressure chamber 236 corresponding to the arbitrary internal individual electrode and thereby gives some energy to the ink present in the pressure chamber 236, a droplet of ink is ejected from the ink ejection nozzle 235 communicating with the pressure chamber 236, and a desired image is recorded on the recording medium.

Figure 24:
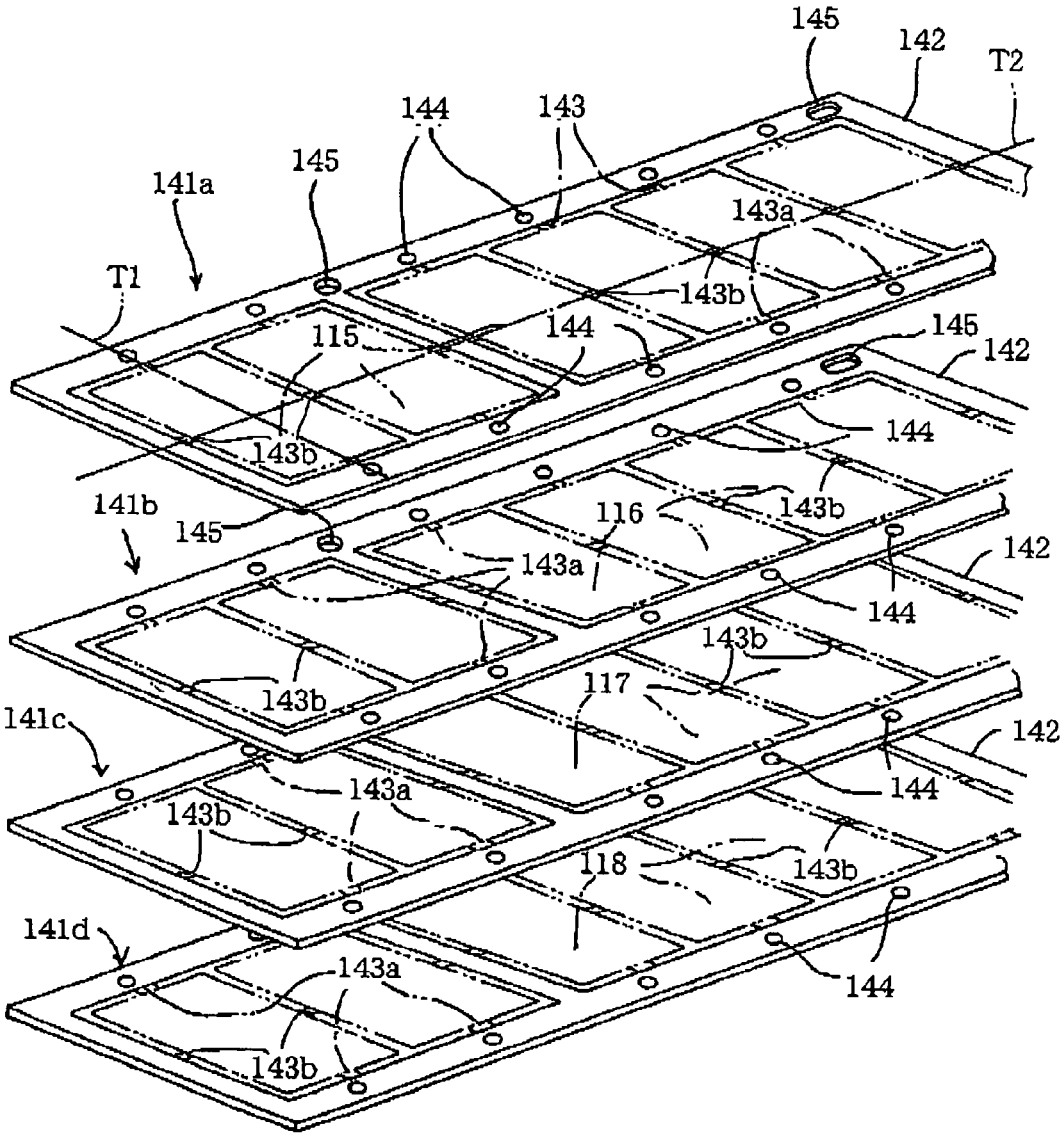
FIG. 24 is a view corresponding to FIG. 13, for explaining a method of producing another ink jet printer head to which the present invention is applied.

In the second embodiment shown in FIG. 13, the sheet members 115 through 118 of each of the lead frames 141*a* through 141*d* are integrally connected to the frame portion 142 via the bridge portions 143. However, as shown in FIG. 24, the sheet members 115 through 118 of each lead frame 141*a* through 141*d*, and the frame portion 142 may be integrally connected to each other via first groups of bridge portions 143*a* and second groups of bridge portions 143*b* that correspond to the first groups of bridge portions 53 and the second groups of bridge portions 54, respectively, that are employed by the first embodiment shown in FIG. 5. However, the bridge portions 143*a* of each of the first groups are located on the first centerline T1 of a corresponding one of the sheet members 115 through 118; and the bridge portions 143*b* of each of the second groups are located on the second centerline T2 of a corresponding one of the sheet members 115 through 118. In this case, the channel unit 111 as a sheet-member stacked structure is produced by a method including a step of stacking the plurality of lead frames 141*a* through 141*d* each of which includes the plurality of sheet members 115 through 118, on each other, and thereby stacking the sheet members of the each lead frame, on the sheet members of the other lead frame or frames. The each lead frame 141*a* through 141*d* includes the frame portion 142 and the sheet members 115 through 118 each of which has a substantially rectangular shape having two first opposite sides (i.e., two opposite short sides) and two second opposite sides (i.e., two opposite long sides), and the sheet members 115 through 118 are connected to the inner peripheral portion of the frame portion 142, such that the sheet members are arranged in a first reference direction, the two opposite short sides of each of the sheet members extend parallel to each other in the first reference direction, and the two opposite long sides of the each sheet member extend parallel to each other in a second reference direction substantially perpendicular to the first reference direction. The lead frame 141*a* through 141*d* additionally includes the plurality of first groups of bridge portions 143*a* each group of which integrally connect the two opposite short sides of a corresponding one of the sheet members 115 through 118, to the inner peripheral portion of the frame portion 142, and the plurality of second groups of bridge portions 143*b* each group of which integrally connect the two opposite long sides of a corresponding one of the sheet members 115 through 118, to the inner peripheral portion of the frame portion 142 and one of the two opposite long sides of its adjacent sheet member, or to respective one long sides of its two adjacent sheet members. This producing method additionally includes a step of stacking the plurality of sheet members 115 through 118 on each other via an adhesive, such that respective contact surfaces of each pair of adjacent sheet members of the stacked sheet members are adhered to each other with the adhesive. The contact surface of at least one of the each pair of adjacent sheet members 115 through 118 has the at least one relief groove 146 through 148 which is formed along at least one location where the adhesive is applied and which does not extend through a thickness of the at least one sheet member. Each of the stacked sheet members 115 through 117 except for one 118 of the two opposite, outermost sheet members 115, 118 of the stacked sheet members 115 through 118 has at least one relief hole 149, 149', 150, 151 which communicates with the at least one relief groove 146 through 148 of the at least one sheet member and which is formed through a thickness of the each sheet member 115, 116, 117, and at least a portion 149*a*, 149' of the at least one relief hole 149, 149' of the other 115 of the two outermost sheet members 115, 118 has the cross-section area greater than the cross-section area of the at least one relief hole 150, 151 of each of the stacked sheet members 116, 117 except for the two outermost sheet members 115, 118. At least that portion 149*a*, 149' of the at least one relief hole 149,149' of the other outermost sheet member 115 opens in the outer surface of the other outermost sheet member 115. The producing method further includes a step of stacking the plurality of sheet members 115 through 118 on each other. The sheet members include the base sheet 118 as the liquid-chamber sheet member that is formed of the rolled metal sheet and has the pressure chambers 119 as the liquid chambers that are arranged, separately from each other, in the direction substantially perpendicular to the direction of rolling of the metal sheet in which the microgrooves (see FIG. 23) as the rolling marks or streaks extend.

It is to be understood that the present invention may be embodied with other changes and improvements that may occur to a person skilled in the art, without departing from the spirit and scope of the invention defined in the claims.

What is claimed is:

1. An ink jet printer head produced by a method comprising:

stacking a plurality of sheet members on each other, such that at least one adhesive layer is provided on at least one of opposite major surfaces of an ink-chamber sheet member as one of the sheet members;

wherein the ink-chamber sheet member is formed of a rolled metal sheet having a plurality of microgrooves, formed by rolling in at least one of opposite major surfaces thereof that defines said at least one major surface of the ink-chamber sheet member; and wherein the ink-chamber sheet member has a plurality of ink chambers which are supplied with at least one sort of ink, and which are separate from each other in a direction substantially perpendicular to a direction of rolling of the metal sheet in which the microgrooves are formed.

2. The ink jet printer head according to claim 1;

wherein the method comprises the step of stacking the plurality of sheet members on each other so as to provide a channel unit, the sheet members including the ink-chamber sheet member which is formed of the rolled metal sheet and which has a plurality of recesses defining the plurality of ink chambers, respectively, and wherein the channel unit includes:

a plurality of ink ejection nozzles which open in an outer surface of the channel unit and which communicate with the plurality of ink chambers, respectively;

a plurality of ink channels which connect the ink chambers to the ink ejection nozzles, respectively; and at least one manifold chamber which stores said at least one sort of ink supplied from at least one ink supply source and supplies said at least one sort of ink to the ink chambers.

3. The ink jet printer head according to claim 1;

stacking a plurality of lead frames, each of which includes a plurality of sheet members, on each other, and thereby stacking the sheet members of said each lead frame on the sheet members of an other lead frame, or other lead frames, of the plurality of lead frames;

wherein each lead frame includes a frame portion and the sheet members;

wherein each of the sheet members has a substantially rectangular shape having two first opposite sides and two second opposite sides;

wherein the sheet members are connected to an inner peripheral portion of the frame portion, such that the sheet members are arranged in a first direction, the two first opposite sides of each of the sheet members extend parallel to each other in the first direction, and the two second opposite sides of said each sheet member extend parallel to each other in a second direction substantially perpendicular to the first direction;

wherein said each lead frame additionally includes:

a plurality of groups of first bridge portions each group of which integrally connect the two first opposite sides of a corresponding one of the sheet members, to the inner peripheral portion of the frame portion; and at least three second bridge portions;

wherein two second bridge portions, of the at least three second bridge portions, each integrally connects one of the two second opposite sides of a corresponding one of two opposite end sheet members of the sheet members arranged in the first direction, to the inner peripheral portion of the frame portion; and wherein at least one second bridge portion, of the at least three second bridge portions, integrally connects one of the two second opposite sides of at least one of the sheet members, to one of the two second opposite sides of an adjacent one of the sheet members that is located adjacent said at least one sheet member; and wherein the stacked sheet members of said each lead frame are disconnected from the first and second bridge portions thereof, such that said each sheet member has respective disconnected surfaces on the first and second opposite sides thereof.

4. The ink jet printer head according to claim 3;

wherein each of the first bridge portions of said each group includes a weakened portion which is located at a position nearer to said corresponding sheet member than the inner peripheral portion of the frame portion.

5. The ink jet printer head according to claim 4;

wherein the two first opposite sides of said each sheet member include respective recessed portions; and wherein the respective recessed portions have respective bottom surfaces to which the first bridge portions of a corresponding one of the plurality of groups are connected in respective directions parallel to the second direction, such that the respective weakened portions of the first bridge portions of said corresponding group are located in respective inner spaces of the respective recessed portions.

6. The ink jet printer head according to claim 3;

wherein each of the at least three second bridge portions includes a weakened portion which is located at a position nearer to a corresponding one of said corresponding sheet end member and said at least one sheet member than a corresponding one of the inner peripheral portion of the frame portion and said one second side of the adjacent sheet member.

7. The ink jet printer head according to claim 6;

wherein the two second opposite sides of said each sheet member include respective recessed portions having respective bottom surfaces to which corresponding two second bridge portions of the at least three second bridge portions are connected in respective directions parallel to the first direction, such that the respective weakened portions of the corresponding two bridge portions are located in respective inner spaces of the respective recessed portions.

8. The ink jet printer head according to claim 7;

wherein each of the respective recessed portions of the two second opposite sides of said each sheet member is formed through a thickness of said each sheet member in a third direction perpendicular to the first and second directions.

9. The ink jet printer head according to claim 3;

wherein said each lead frame further includes:

at least three said sheet members; and at least four said second bridge portions including:

the two second bridge portions each of which integrally connects said corresponding one of the two end sheet members to the inner peripheral portion of the frame portion; and two second bridge portions which integrally connect the two second opposite sides of one of the sheet members, to one of the two second opposite sides of one of two adjacent sheet members that are located on either side of, and adjacent to, said one sheet member, and one of the two second opposite sides of an other of the two adjacent sheet members, respectively.

10. The ink jet printer head according to claim 3;

wherein said each lead frame includes:

at least three pairs of said second bridge portions including:

two pairs of said second bridge portions each pair of which integrally connect said corresponding one of the two end sheet members to the inner peripheral portion of the frame portion; and at least one pair of said second bridge portions which integrally connect said at least one sheet member to the adjacent sheet member.

11. The ink jet printer head according to claim 1;

stacking a plurality of sheet members on each other via an adhesive, such that respective contact surfaces of each pair of adjacent sheet members of the stacked sheet members are adhered to each other with the adhesive;

wherein the contact surface of at least one of said each pair of adjacent sheet members has at least one relief groove which is formed along at least one location where the adhesive is applied, which does not extend through a thickness of said at least one sheet member, and which relieves a portion of the adhesive;

wherein each of the stacked sheet members, except for one of two opposite, outermost sheet members of the stacked sheet members, has at least one relief hole which communicates with said at least one relief groove of said at least one sheet member, which is formed through a thickness of said each sheet member, and which relieves said portion of the adhesive;

wherein at least a portion of said at least one relief hole of an other of the two outermost sheet members has a cross-section area greater than a cross-section area of said at least one relief hole of each of the stacked sheet members, except for the two outermost sheet members; and wherein at least said portion of said at least one relief hole of said other outermost sheet member opens in an outer surface of said other outermost sheet member.

12. The ink jet printer head according to claim 11;

wherein said at least one relief hole of said other of the two outermost sheet members includes:

a first portion having a first cross-section area and opening in the outer surface of said other outermost sheet member; and a second portion having a second cross-section area and opening in the contact surface of said other outermost sheet member;

wherein the first cross-section area is greater than the second cross-section area; and wherein the first portion is at least partly filled with the adhesive.

13. The ink jet printer head according to claim 11;

wherein said at least one relief hole of said other of the two outermost sheet members has a first cross-section area greater than a second cross-section area of said at least one relief hole of one of the plurality of sheet members that is located adjacent said other outermost sheet member; and wherein said at least one relief hole of said other outermost sheet member is at least partly filled with the adhesive.

14. An ink jet printer head, comprising:

a channel unit including:

a plurality of sheet members which are stacked on each other and which have a plurality of ink ejection nozzles opening in an outer surface of the channel unit;

a plurality of ink chambers communicating with the ink ejection nozzles, respectively;

a plurality of ink channels which connect the ink chambers to the ink ejection nozzles, respectively; and at least one manifold chamber which stores at least one sort of ink supplied from at least one ink supply sources, the at least one manifold chamber supplying said at least one sort of ink to the ink chambers;

wherein the channel unit further includes at least one adhesive layer provided on at least one of opposite major surfaces of an ink-chamber sheet member as one of the sheet members;

wherein the ink-chamber sheet member has a plurality of recesses defining the ink chambers, and is formed of a rolled metal sheet having a plurality of micro grooves formed by rolling in at least one of opposite major surfaces thereof that defines said at least one major surface of the ink-chamber sheet member; and wherein the ink chambers of the ink-chamber sheet member are separate from each other in a direction substantially perpendicular to a direction of rolling of the metal sheet in which the microgrooves are formed.

15. The ink jet printer head according to claim 14, further comprising:

an actuator which is stacked on said one adhesive layer provided on said one major surface of the ink-chamber sheet member having the ink chambers;

wherein the actuator has a plurality of active portions, each of which changes a pressure of the ink accommodated by a corresponding one of the ink chambers, thereby ejecting a droplet of the ink from a corresponding one of the ink ejection nozzles.

16. The ink jet printer head according to claim 14;

wherein each of the ink chambers has a first end communicating with a corresponding one of the ink ejection nozzles, and a second end communicating with said at least one manifold chamber, and is elongate in a lengthwise direction thereof passing through the first and second ends, and wherein the lengthwise direction of said each ink chamber is parallel to the rolling direction in which the microgrooves are formed.

* * * * *